United States Patent [19]

Isowa et al.

[11] Patent Number: 4,919,353

[45] Date of Patent: Apr. 24, 1990

[54] CARDBOARD WEB FEEDING DEVICE FOR CORRUGATOR

[75] Inventors: Eiichi Isowa, Nagoya; Hideshi Kawai; Harumi Kajita, both of Kasugai; Hiroki Matsui, Kasugai, all of Japan

[73] Assignee: Isowa Industry Co., Ltd., Aichi, Japan

[21] Appl. No.: 237,223

[22] Filed: Aug. 26, 1988

[30] Foreign Application Priority Data

Sep. 3, 1987 [JP] Japan ..... 62-221623
Jul. 6, 1988 [JP] Japan ..... 63-90237[U]

[51] Int. Cl.[5] ..... B05H 19/30
[52] U.S. Cl. ..... 242/58.6; 242/79
[58] Field of Search ..... 242/58.6, 58.1, 58.2, 242/58.3, 58.4, 58.5, 79

[56] References Cited

U.S. PATENT DOCUMENTS 3,690,583 9/1972 Herman ..... 242/79 X
4,236,626 12/1980 Noe ..... 242/79 X
4,706,905 11/1987 Torres ..... 242/58.6 X
4,735,372 4/1988 Seki ..... 242/58.1

*Primary Examiner*—John M. Jillions
*Attorney, Agent, or Firm*—Koda & Androlia

[57] ABSTRACT

A web feeding device for a corrugator including a mill roll stand consisting of two swing arm mechanisms with each swing arm mechanism having a pair of swing arms supported on a pivotal shaft which can be turned with a predetermined angle to the positive and negative directions relative to a perpendicular line extending upwardly from the pivotal shaft and disposed such that the pivotal shafts thereof may be parallel to each other, a conveyor for transporting the web rolls disposed between the two swing arm mechanism to extend parallel to the pivotal shafts and two web roll transporting conveyors disposed as outer areas relative to the swing arm mechanisms, respectively, to extended relative to the pivotal shafts.

10 Claims, 29 Drawing Sheets

(a)

(b)

(a)

(b)

(d)

CARDBOARD WEB FEEDING DEVICE FOR CORRUGATOR

FIELD OF THE INVENTION

This invention relates to a cardboard web feeding device for a corrugator, more particularly to a cardboard web feeding device which can reduce the time required for loading or carrying out a cardboard web roll compared with a cardboard web feeding device of a mill roll stand system wherein a conveyer for transporting the cardboard web rolls is disposed at an outer area relative to each of two pairs of swing arms, respectively.

BACKGROUND OF THE INVENTION

There have widely been used corrugators having a constitution wherein a corrugating medium is allowed to have a corrugation with a desired pitch size; said medium is then pasted together with a liner at the crests of corrugation using an adhesive to form a single-faced corrugated board sheet; and the thus obtained single-faced corrugated board sheet is further pasted with a back liner to form a double-faced corrugated board sheet. In such type of corrugators, a single facer for forming a single-faced corrugated board sheet and a double facer for pasting the thus formed single-faced corrugated board sheet with a back liner are used as main devices. Further, indispensable as incidental equipments are cardboard web feeding devices for feeding cardboard webs such as corrugating medium, liner and back liner (these cardboard webs are hereinafter referred to as "web").

These webs are loaded to web feeding devices, in the form of rolls each having predetermined diameters taken up around core paper tubes (hereinafter referred to as "web rolls"), from which the webs are delivered or fed out. Further, in accordance with the order change in the corrugated board sheet to be formed during the process of production, the web rolls are removed from the web feeding devices and loaded on conveying means such as a flat car etc. to be carried out to a specified stockroom.

As a prior art web feeding device to be employed in a corrugator, a mill roll stand of so-called swing arm system as shown in FIG. 21 is widely known. The mill roll stand shown with the numeral 10 comprises two pairs of swing arms 13, each pair comprising right and left arms being connected to horizontal pivotal shafts 11 and 12, respectively, by means of splines. The respective arms 13 have a center block 16 at the tip such that it may oppose its counterpart provided on the other arm 13, and can be fitted into the end portions of a paper tube 15 of a web roll 14.

Carry-in/out tracks 17 are defined on the ground of the factory site, extending from the mill roll stand 10 toward two opposing directions, for carrying the web rolls 14 to and from said mill roll stand. These carry-in/out tracks 17 each comprises a pit formed by digging the ground of the factory site down to a predetermined depth to extend parallel to the pivotal shafts 11 and 12, to which pit a flat car 18 is disposed such that it can travel freely along said pit. The flat car 18 has a table 19 on the top for loading the web roll 14 thereon, and only the table 19 appears above said pit.

To achieve loading of a web roll 14 onto one pair of swing arms 13 supported by the right side pivotal shaft 12 in said mill roll stand 10, the flat car 18 carrying the web roll 14 thereon is allowed to travel along the right side carry-in/out track 17 until it reaches below the swinging loci of said swing arms 13; wherein the swing arms 13 are spaced from each other, and in this state the right side pivotal shaft 12 is turned clockwise until the center blocks 16 may be aligned with the center of the paper tube 15 of the web roll 14.

Subsequently, the swing arms 13 are moved closer to each other to effect chucking of the paper tube 15 of the web roll 14 by means of the center blocks 16, and then the arms 13 are swung counterclockwise upwardly, whereby loading of the web roll 14 (also referred to as "web setting") is achieved. Likewise, the same procedures can be applied to the other pair of swing arms 13 supported on the left side pivotal shaft 11 to load another web roll 14 thereto. The web delivered from the web roll 14 loaded onto the one pair of the swing arms 13 is fed to a predetermined portion of a corrugator not shown.

When the web roll 14 loaded onto the swing arms 13 is unloaded from said arm for returning to the stockroom, or the web roll 14 under loading is replaced with another web roll 14 of a different standard in accordance with the order change during the operation of the line, the swing arms 13 locating at its upper position is swung downward until they may reach immediately above the flat car 18 which is waiting on the carry-in/out track 17. Next, the arms 13 are opened to release chucking against the web roll 14 to load said web roll 14 onto the table 19 of the flat car 18. The swing arms 13 are then swung upward to assume again the upper position and moved farther from each other to wait for the next web roll 14 to be chucked therebetween. Subsequently, the flat car 18 carrying the web roll 14 loaded thereon retracts the carry-in/out track 17 toward the specified stockroom.

When a new web roll 14 is successively loaded, the flat car 18 carrying the web roll 14 thereon travels along the carry-in/out track 17 until it reaches below the swinging loci of the swing arms 13, and loading of the web roll 14 against the arms 13 is achieved in the order as described above.

Thus, in a web feeding device of a conventional mill roll stand system wherein a conveyer for transporting web rolls is disposed at an outer area relative to each of the two pairs of swing arms, respectively, the swing arms 13 are swung diagonally downward after a new web roll 14 is carried in, to effect centering of the center blocks 16 with the paper tube 15 of the web roll 14, and then both arms are moved closer to each other to effect chucking of the web roll 14 therebetween, as described above. Next, the two arms 13 are swung diagonally upward to complete loading of the web roll 14.

On the other hand, when a web roll 14A supported by the two swing arms 13 under delivery is replaced with a different new web roll 14B, chucking against the web roll 14A is released after the two swing arms 13 are swung diagonally downward. While the former web roll 14A is carried out after the arms 13 are swung diagonally upward, these arms 13 must be waiting in the above posture, i.e. in an upwardly tilted posture, for the time until carrying in of the new web roll 14B is completed. After the new web roll 14B is carried in, the swing arms 13 are swung diagonally downward to effect centering of the center blocks 16 with the paper tube 15 of the web roll 14B. Subsequently, the two arms 13 are moved closer to each other to chuck the web roll 14B therebetween, and then they are swung upward again to achieve loading of the new web roll 14B.

Thus, for the replacement of web rolls, it is necessary not only to reciprocate the swing arms horizontally along the pivotal shaft but also to allow them to be waiting at the said position in an upwardly tilted posture for the time until completion of carrying out of the former web roll and carrying in of the new web roll. Accordingly, under the present circumstances, the web setting operation requires quite a lot of time loss. Therefore, in the corrugated board sheet production industries in which there is a necessity for coping with frequent order change due to small lot productions, reduction of the time cycle to be required for the replacement of web rolls is extremely important. In this respect, no prior art web feeding device could sufficiently meet such demand.

SUMMARY OF THE INVENTION

This invention has been proposed in view of the abovementioned disadvantages inherent in the web feeding device for a corrugator and for solving them suitably, and is directed to provide a web feeding device which can greatly reduce the time cycle required for the removal and replacement of web rolls in accordance with frequent order change, facilitate automation of the system and also reduce the cost for production by simplifying the entire device.

Since the web feeding device according to this invention is composed of a mill roll stand comprising two swing arm mechanisms, each having a pair of swing arms supported on a pivotal shaft which can be turned with a predetermined angle to the positive and negative directions relative to the perpendicular line extending upwardly from said pivotal shaft, disposed in such a way that the pivotal shafts thereof may be parallel to each other; a conveyer for transporting the web rolls disposed between said two swing arm mechanisms to extend parallel to said pivotal shafts; and two web roll transporting conveyers each disposed at an outer area relative to each of two pairs of swing arms, respectively, to be parallel to said pivotal shafts, the loading of the web roll to the arms or releasing of the web roll therefrom only requires a basic operation of turning the swing arms to a predetermined direction. Accordingly, compared with any conventional mill roll stand in which swing arms must be reciprocated to the positive and negative directions to achieve the same purpose, time cycle required for achieving the above operation may notably be reduced in the device of this invention.

Further reduction in the time cycle can be realized by providing a lifter for the web roll transporting conveyer, and by ascending the lifter loading a web roll thereon simultaneously when said swing arms are turned such that the web roll and the swing arm may approach to each other when the web roll is loaded to the swing arms. Moreover, the present device, because of its simple structure, enjoy advantages of easy maintenance and inspection, and reduced production cost.

DETAILED DESCRIPTION OF THE INVENTION

Next, the web feeding device for a corrugator according to this invention will be described below by way of preferred embodiments and referring to the attached drawings.

Figure 1:
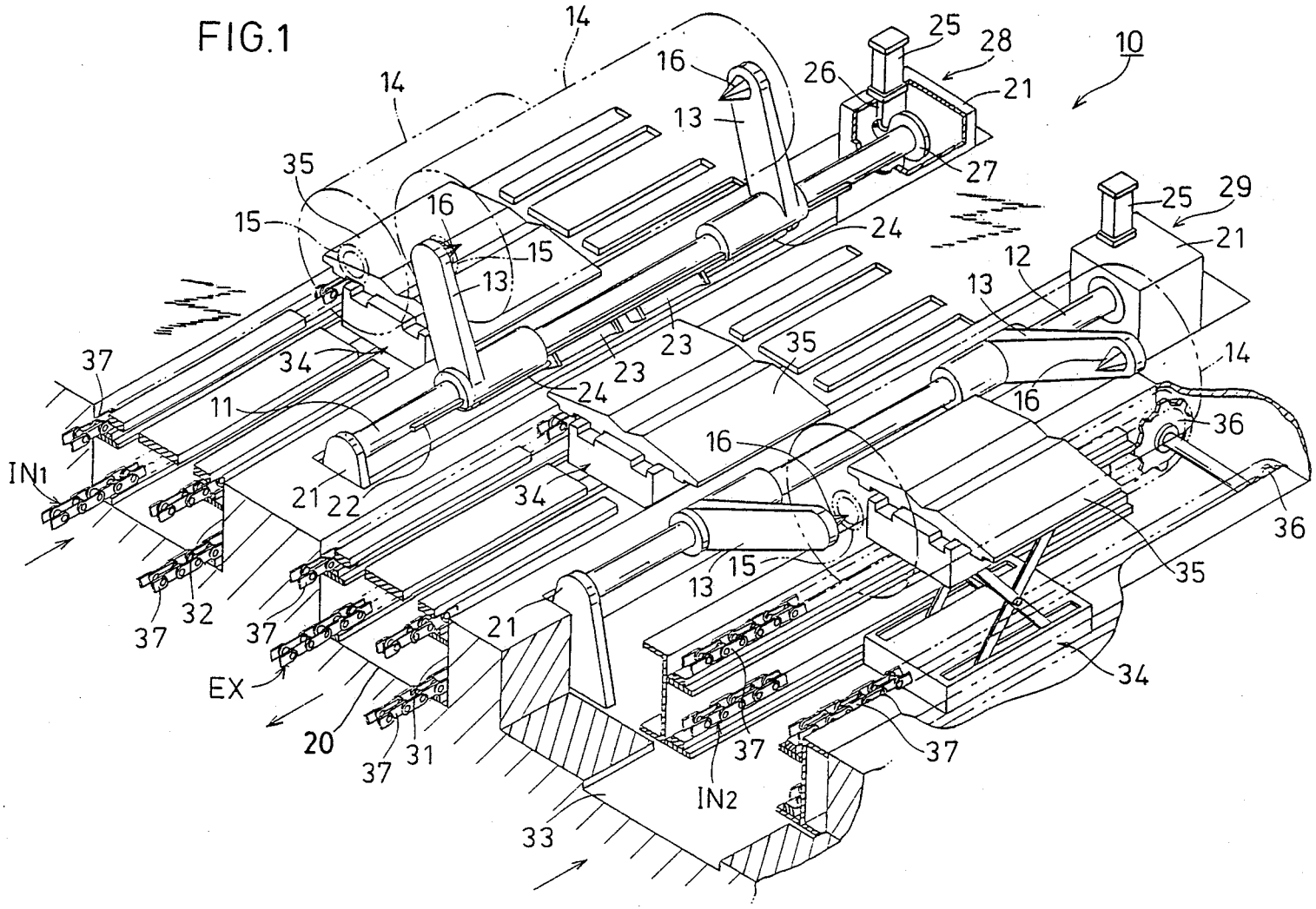
FIG. 1 shows schematically a perspective view of a web feeding device according to a preferred embodiment of this invention.
Figure 2:
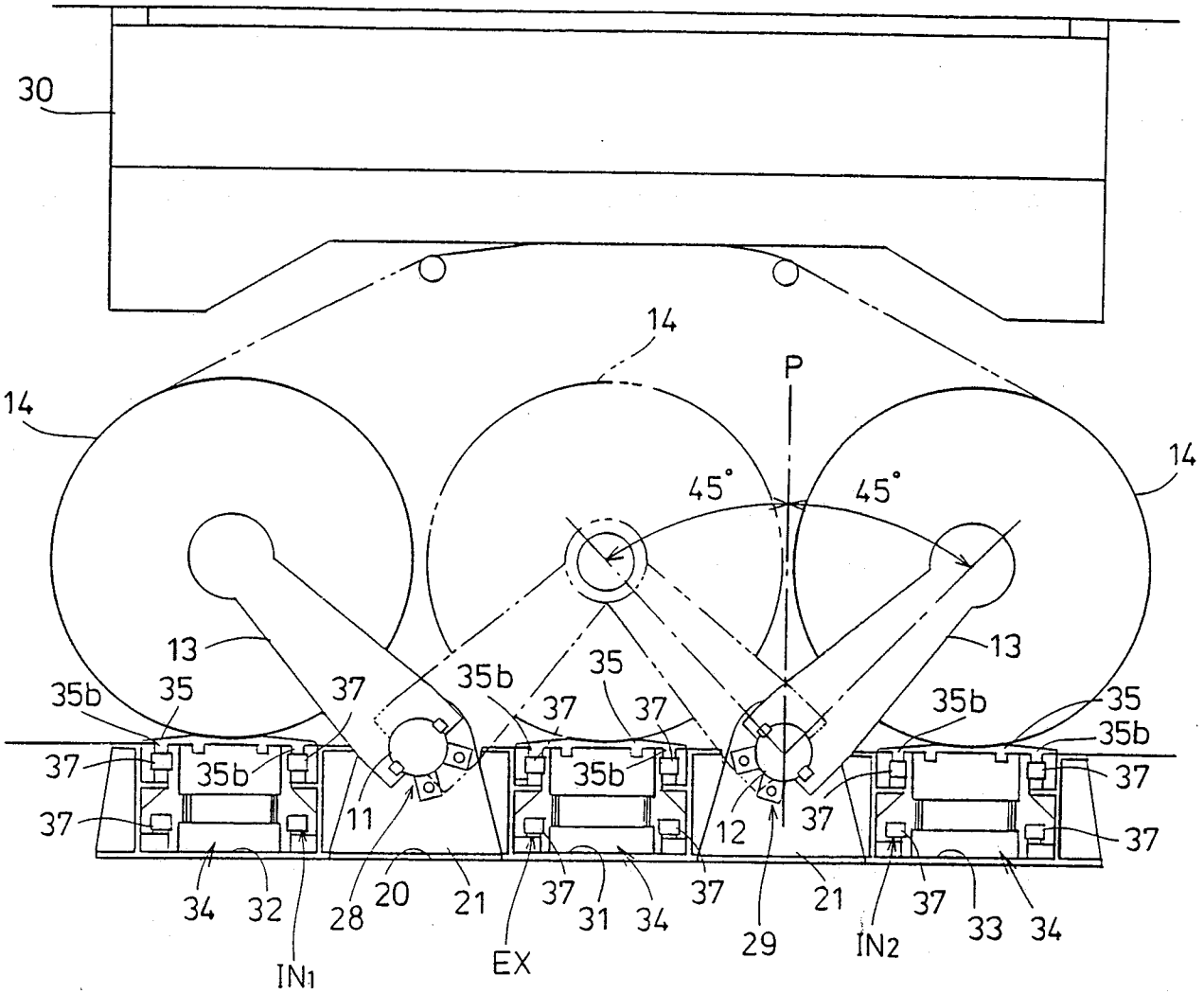
FIG. 2 shows a front view of the web feeding device shown in FIG. 1 disposed below a splicer.

The mill roll stand according to the embodiment as shown schematically in FIGS. 1 and 2 is of the swing arm system. It should be noted, however, that the swing arm mechanism constituting the mill roll stand 10 has a pair of swing arms on the right and left sides relative to the perpendicular line extending upwardly from a shaft on which they are supported, and which can be swung with a predetermined angle. For example, a pivotal shaft 11 is pivotally supported at each end by a pair of bearings 21 disposed on a base 20 and spaced with a predetermined distance from and to oppose each other. The above pair of swing arms 13 are connected at the hinge portion to this pivotal shaft 11 by means of splines. To describe in detail, keys 22 are provided on the pivotal shaft 11 to protrude therefrom parallel to the axis of the pivotal shaft 11, and the hinge portion of the above swing arms 13 are locked by the keys 22, respectively, so that the swing arms 13 may not turn relative to said pivotal shaft 11 and that they may be moved closer or farther along the axis of the pivotal shaft 11. A pair of hydraulic cylinders 23 are also fixed to the pivotal shaft 11 parallel to said pivotal shaft 11, respectively, and the tip end of a piston rod 24 in each cylinder 23 is fixed to the hinge portion of the swing arm 13. Therefore, upon application of pressure to both of the cylinders 23 synchronously, the above pair of swing arms 13 are designed to be moved closer or farther to each other symmetrically along the pivotal shaft 11.

Another hydraulic cylinder 25 is disposed at the bearing 21 supporting one end of the above pivotal shaft 11, and a piston rod 26 in this cylinder 25 is pivoted to a lever 27 fixed to said pivotal shaft 11. Upon application of pressure to the above hydraulic cylinder 25, the pivotal shaft 11 is designed to be turned with a predetermined angle together with the above pair of swing arms 13 supported thereon. The turning angle of the pivotal shaft 11 and the swing arms 13 is set to be 45° each in the positive and negative directions relative to the perpendicular line P, i.e. 90° in total, as shown in FIG. 2. Accordingly, the swing arms 13, as will be described later in more detail, can select either one of the carry-in conveyer and carry-out conveyer which are extending parallel to each other on both sides of the swing arm mechanism, respectively, to stop above either one of said conveyers in a tilted posture.

At the tip of each swing arm 13, a center block 16 is fixed to protrude toward the tip end of the other swing arm 13 with which the former swing arm 13 is forming a pair, so that a paper tube 15 of a web roll 14 may be chucked at both ends by these center blocks 16. If the entire mechanism constituted around the pivotal shaft 11 is referred to as a swing arm mechanism 28, exactly the same mechanism is disposed relative to the other pivotal shaft 12 which is parallel to said pivotal shaft 11 as a swing arm mechanism shown with the numeral 29.

The mill roll stand 10 shown in FIG. 1 is adapted to be disposed below a known splicer 30 which performs splicing of webs, as shown in FIG. 2. On the floor of the factory site where such splicer 30 and the above mill roll stand 10 as well are installed, three pits each having a predetermined depth are defined parallel to the pivotal shafts 11 and 12 each supporting thereon swing arms 13 (in the orthogonal direction relative to the line of feeding webs). Namely, at a position intermediate between the two pivotal shafts 11 and 12 each constituting the swing arm mechanism 28 or 29 in the above mill roll stand 10, a first pit 31 is defined for disposing a web roll carry-out conveyer EX to be housed therein.

A second pit 32 and a third pit 33 are each formed parallel to the first pit 31 at an outer area relative to each of the pivotal shafts 11 and 12 in said two swing arm mechanisms 28 and 29, respectively. A web roll carry-in conveyer $IN_1$ is disposed to be housed in the second pit 32; whereas a web roll carry-in conveyer $IN_2$, in the third pit 33. Namely, in a web feeding device according to a first aspect of this invention, the web roll carry-out conveyer EX is disposed between the two pivotal shafts 11 and 12; whereas on the left side relative to the pivotal shaft 11, the web roll carry-in conveyer $IN_1$ is disposed, and on the right side relative to the pivotal shaft 12, a web roll carry-in conveyer $IN_2$ is disposed.

Figure 3:
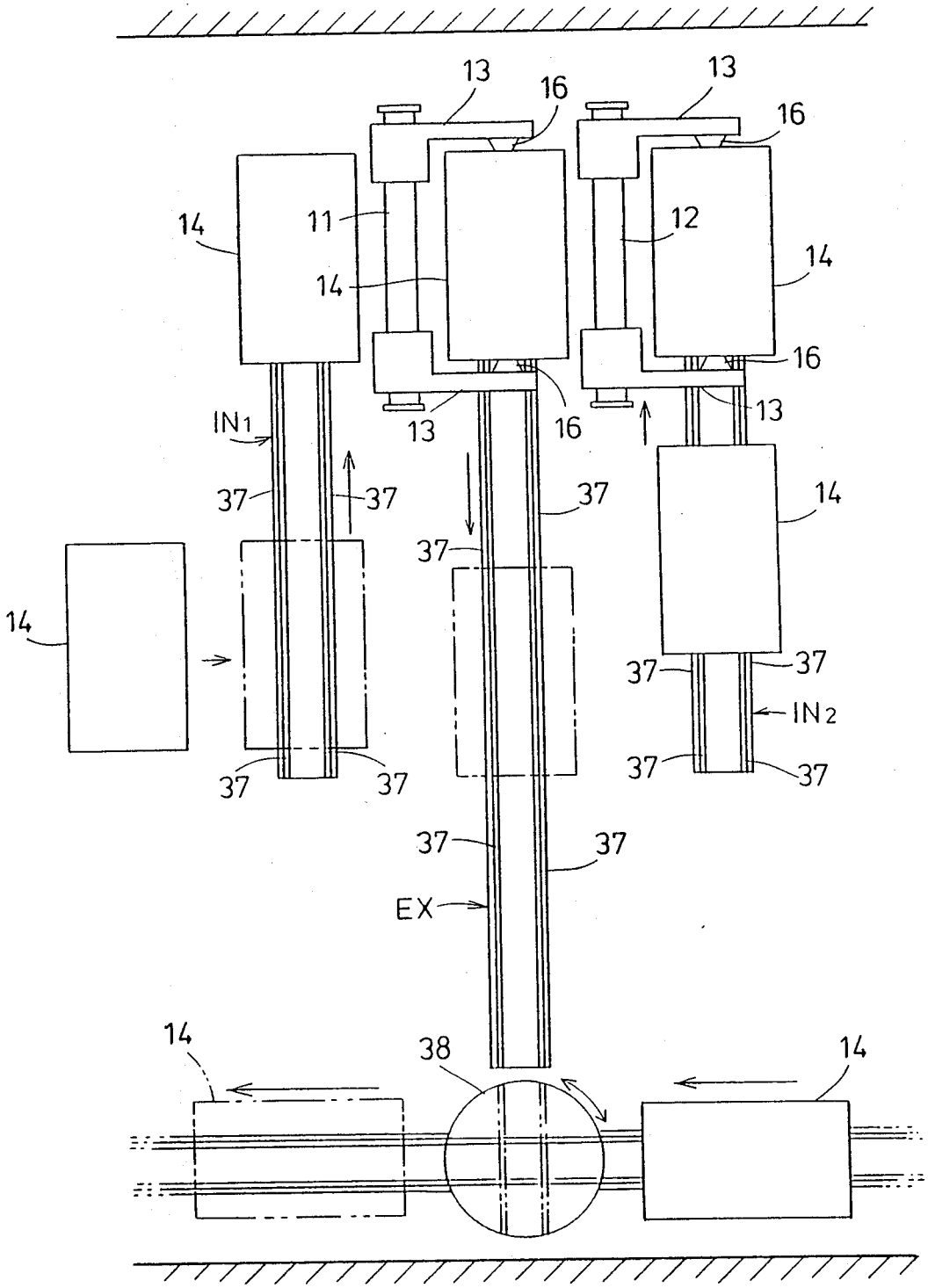
FIG. 3 shows a plan view of an exemplary layout pattern where the web feeding device shown in FIG. 1 is installed in a factory, in which a wall of the factory locates by the driving zone in the line of corrugator.
Figure 6:
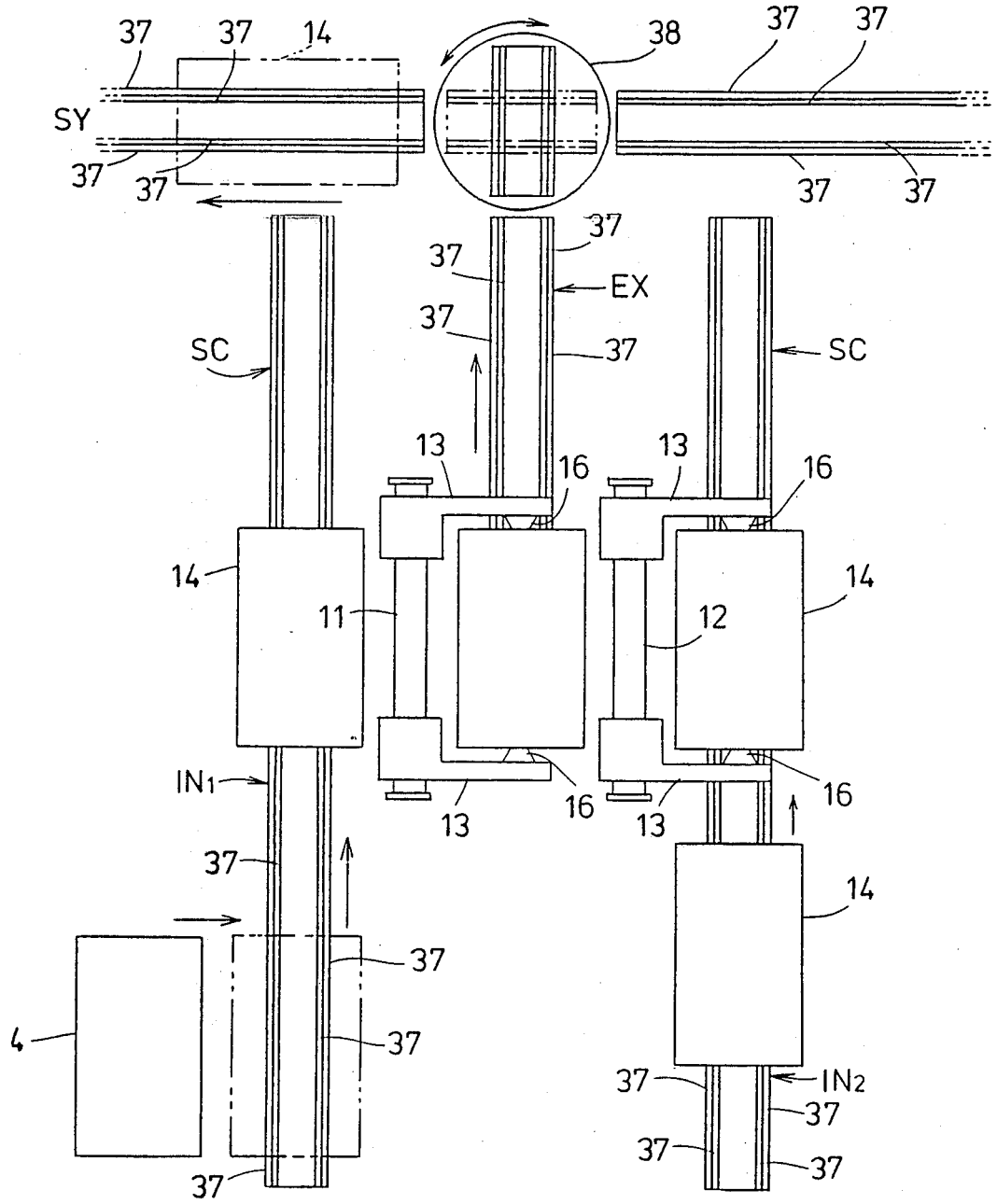
FIG. 6 and FIG. 7 each show another exemplary layout pattern when the web feeding device shown in FIG. 1 is installed in a factory.
Figure 7:
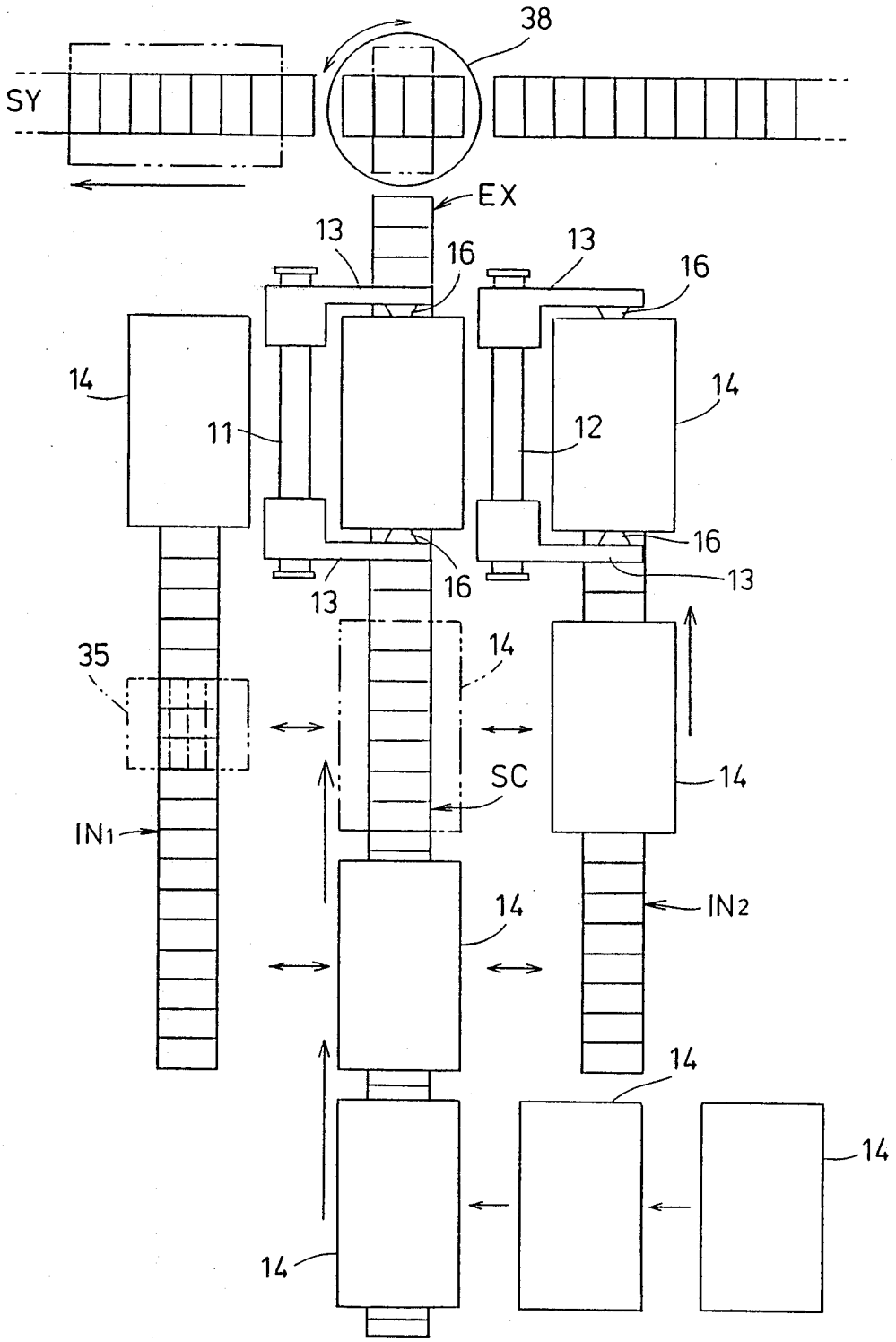

While the above-mentioned conveyers (EX for carrying out web rolls 14), and $IN_1$ and $IN_2$ (for carrying in web rolls 14) are extended on the floor of the factory site parallel to each other from the above-mentioned first to third pits, respectively, as starting points of one side, layout patterns for these conveyers may come out in various conceivable types as shown in FIGS. 3, 6 and 7. Among these layout patterns, the most typical one is as shown in FIG. 3, which is supposed to be most suitable for the present spatial condition in many factories of users having corrugator lines installed therein.

To describe in detail, when a zone where an operation panel is disposed is defined as an "operation zone", and a zone which is to be located at a portion opposite to the operation zone and where driving power is transmitted through a line shaft is defined as a "driving zone" in the line of corrugator comprising serially connected components to be extended into an elongated line, an arrangement is frequently employed in which the driving section of the corrugator is disposed adjacent to the wall of the factory in order to utilize the limited space effectively. Thus, in a factory site where it is difficult to secure a large space for the driving zone, the web roll carry-out conveyer EX is extended toward the "operation zone" from the first pit 31; likewise, the conveyers $IN_1$ and $IN_2$ may be adapted to be extended correspondingly from the second pit 32 and the third pit 33 toward the "operation zone" as shown in FIG. 3.

In a web feeding device according to the embodiment shown in FIGS. 1 and 2, a web roll carry-out conveyer EX is adapted to be extended between the two swing arm mechanism 28 and 29 constituting the mill roll stand 10; and at an outer area relative to each of the respective swing arm mechanisms 28 and 29, web roll carry-in conveyers $IN_1$ and $IN_2$ are extended parallel to each other, respectively. Each pair of swing arms 13 chuck a web roll 14 carried in loaded on the conveyer $IN_1$ ($IN_2$) and then are swung upward to a position above the carry-out conveyer EX, and at this position the web is fed out. When the web roll 14 is then replaced with a new web roll 14 of the next order, the used web roll 14 is released from the swing arms at a position above the carry-out conveyer EX.

In this process, the angle of turning the swing arms 13 is set in such a way that they may be turned 45° each to the positive and negative directions relative to the perpendicular line P as described above and they cannot be turned at any angle greater than the above degree. It is of course possible technically to use a turning angle greater than the above degree. However, if such larger angle is used, the width of the mill roll stand 10 may naturally be increased proportionally. Thus, even if the swing arms 13 are turned with an angle of 45° relative to the perpendicular line P and stopped there in a tilted posture, the center blocks 16 may not be aligned with the center of the paper tube 15 of the web roll 14 loaded on the respective carry-in conveyers $IN_1$ or $IN_2$, leading to failure in chucking.

Therefore, in the present embodiment, the centering of the paper tube 15 of the web roll 14 with the opposing center blocks 16 of the swing arms 13 is facilitated by disposing a lifter 34 (to be described later) in each pit in which the conveyer EX, $IN_1$ or $IN_2$ is provided and by ascending the web roll 14 to a predetermined level by said lifter. Further in such an embodiment, it is necessary to interpose a pallet which is removable from the conveyer in order to lift up the web roll 14 from each conveyer EX, $IN_1$ or $IN_2$. Therefore, a slat conveyer conventionally used may not be usable at least as the conveyers $IN_1$ and $IN_2$ for carrying in web rolls 14.

Incidentally, the web feeding device shown in FIG. 1 has a structure in which the lifter 34 is provided for both the conveyer EX for carrying out web rolls 14, and the conveyers $IN_1$ and $IN_2$ for carrying in web rolls 14. The constitution of the conveyers for carrying in and carrying out the web rolls 14 utilizing the lifter 34 and the pallet 35 will then be described referring to FIGS. 8 to 11.

The conveyer EX for carrying out the web rolls 14 and the conveyers $IN_1$ and $IN_2$ for carrying in web rolls 14 used in this embodiment is a kind of so-called free flow conveyer. For example, a pair of endless roller chains 37 are provided in each of the pits 31, 32 and 33 to be extended around a plurality of sprockets 36, to be parallel to each other so that they may be circulated continuously to a predetermined direction. As described above the pit 31, 32 and 33 extending from the operation zone of the corrugator are covered so that they may not hinder operators' passage. In this cover, two grooves are formed for receiving the above-mentioned pair of endless roller chains 37.

Figure 8:
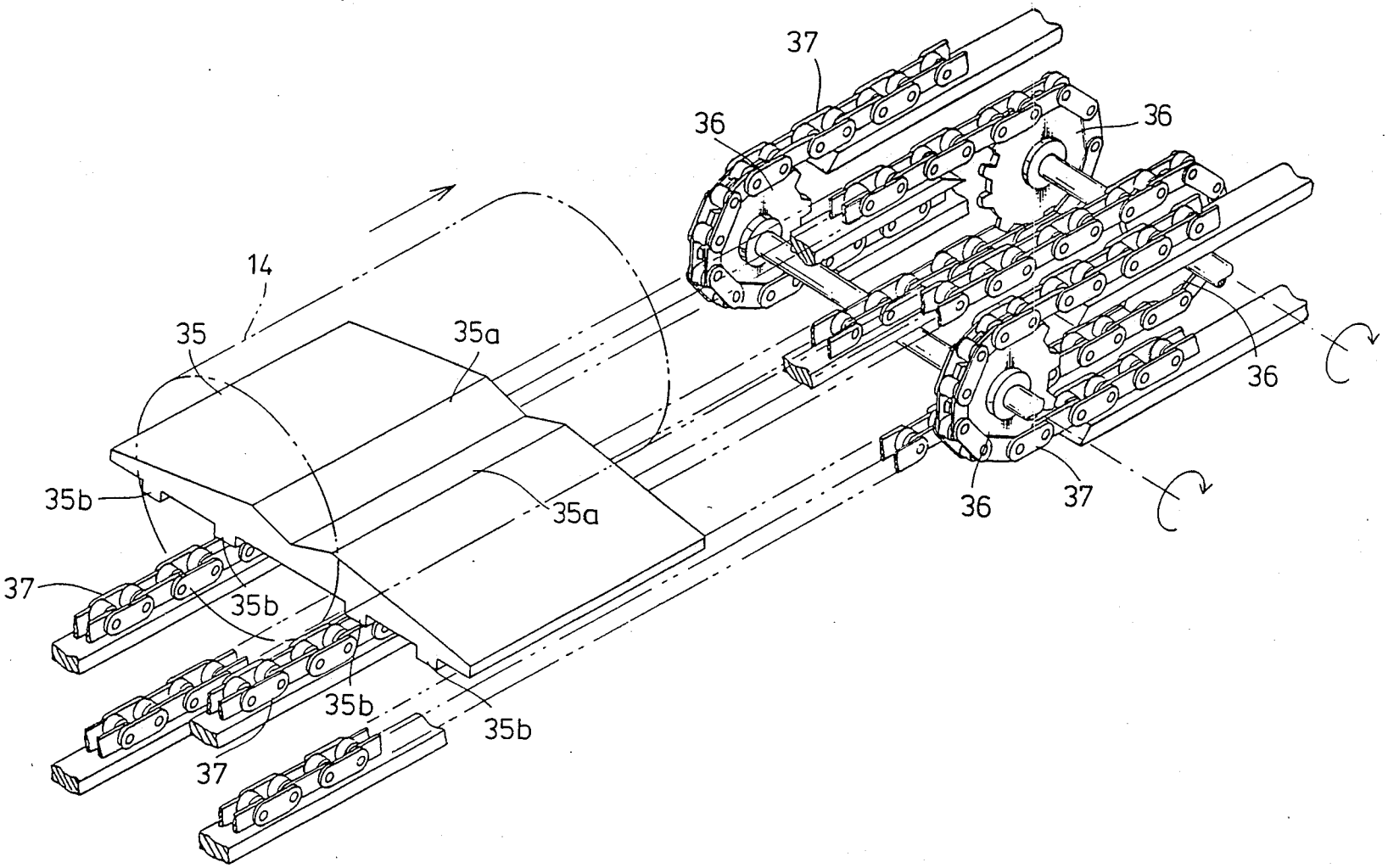
FIG. 8 shows in perspective view a schematic constitution of a carry-in/out conveyer, using a pallet for carrying web rolls.
Figure 9:
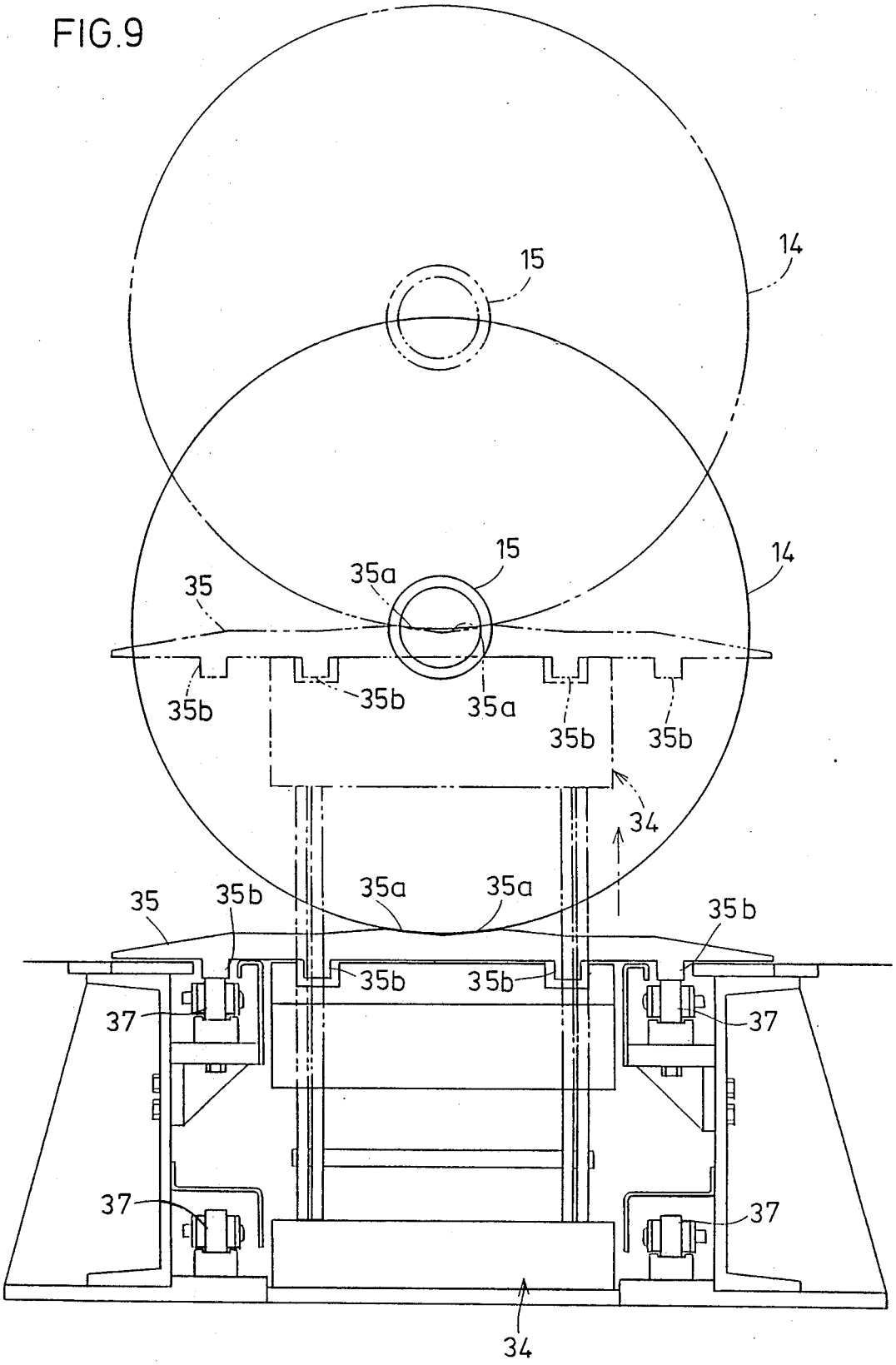
FIG. 9 shows in front view a schematic constitution of a lifter mechanism for loading a pallet thereon.

The pallet 35 has two slant planes 35*a* to form a V-shaped cross-section which enables loading of a web roll 14 stably at the center portion thereof as shown in FIGS. 8 and 9, and protruding portions 35*b*, which can be placed on said two roller chains 37 are formed protruding downward across the bottom surface of said pallet. Incidentally, it is also possible to dispose two parallel pairs of roller chains 37 each pair having a different space therebetween. In such constitution, protruding portions 35*b* to be placed on the outer pair of roller chains 37 and those to be placed on the inner pair of roller chains 37 may preferably be formed independent of one another. As shown in FIG. 8, the inner pair of roller chains 37 and the outer pair of roller chains 37 can be circulated selectively by driving the corresponding sprocket disposed relative to said roller chains 37, independently.

As described above, each pallet 35 is designed to be removably mounted relative to the roller chains 37 constituting the driving system for each conveyer EX, $IN_1$ and $IN_2$. In each of the pits 31, 32 and 33 defined parallel to each other and adjacent to the mill roll stand 10, a pantographic lifter 34 is disposed correspondingly to be housed therein, respectively. This lifter 34 is driven by a predetermind driving source not shown such as a hydraulic cylinder for its ascending or descending movement. When the lifter 34, for example, is ascended, it is first brought into contact upwardly with the bottom surface of the pallet 35 placed on the roller chains 37 and positioned adjacent to the mill roll stand 10, and then said pallet 35 is separated from the conveyer driving system to be ascended to a predetermined level. When the above driving source is driven reversely, the lifter 34 descends to place the pallet 35 stably on the roller chain 37 constituting the conveyer driving system, and it further descends to a predetermined position and stops there.

Figure 10:
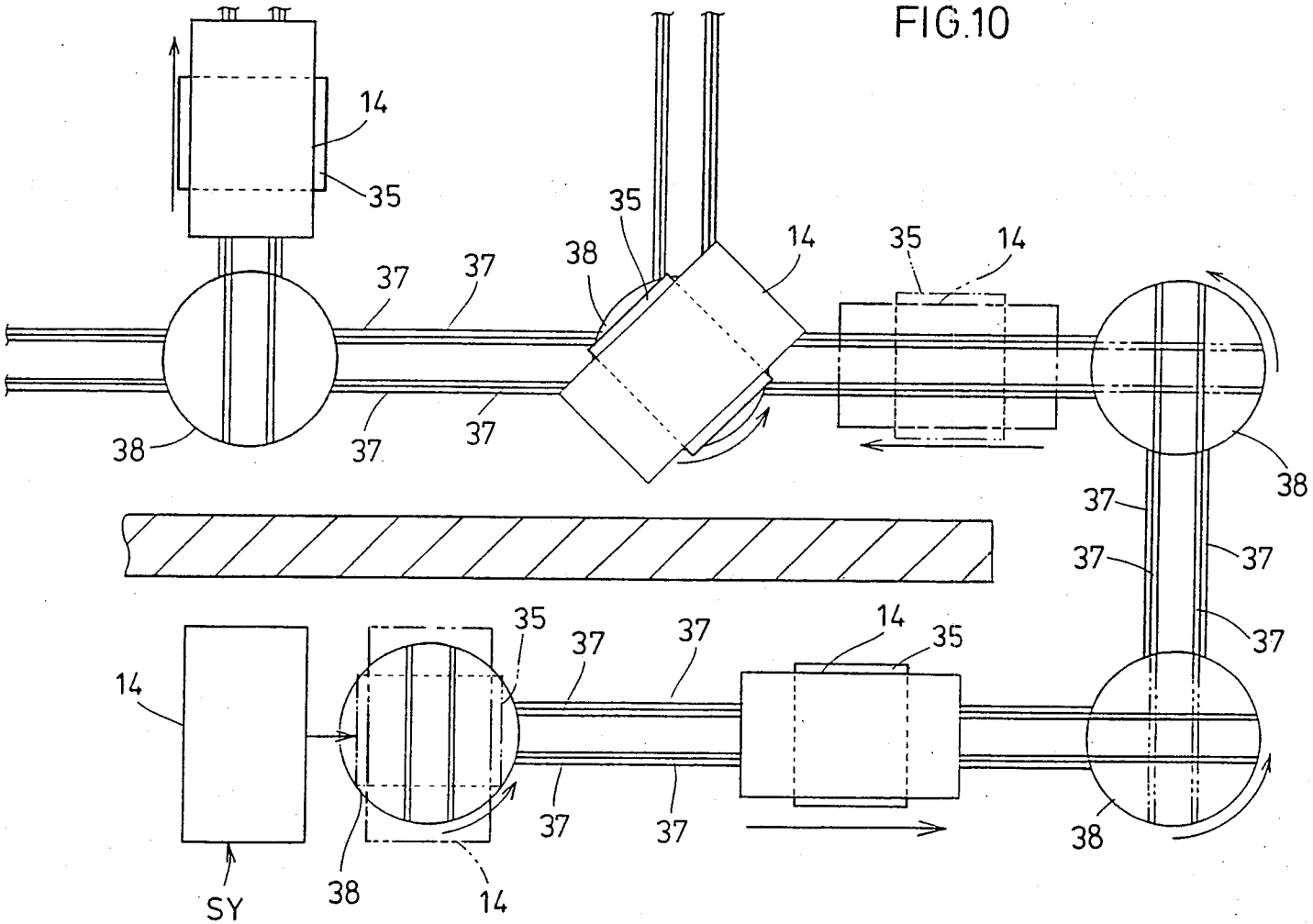
FIG. 10 shows in front view a layout pattern of a web roll transporting conveyer.

FIG. 10 shows an example layout pattern in a factory where the above-mentioned free flow conveyer mode web roll conveying system is used, wherein an outer pair of roller chains 37 and an inner pair of roller chains 37 are disposed parallel to each other as described referring to FIG. 8. A turn table 38 is provided at each position at which the direction of the roller chains 37 are turned by 90°. To describe in detail, in FIG. 10 the web roll 14 is loaded on the pallet 35 in the stockyard SY for storing web rolls 14, and a group of these pallets 35 can be forwarded by driving either one of the outer pair of roller chains 37 and inner pair of roller chains 37 according to a command as necessary. When the direction of the pallet 35 is to be turned, it is turned by the turntable 38 by 90° and then forwarded to the succeeding conveyer.

During the time when the web roll 14 is being turned together with the pallet 35 on the turntable 38, the pallet 35 present in the upstream of the line is in pause as shown in FIG. 10. Even when a plurality of pallets 35 are present on a common conveyer line, one pallet 35 can be forwarded, while the other pallet 35 can be kept in pause by driving the roller chains 37 selectively.

Figure 11:
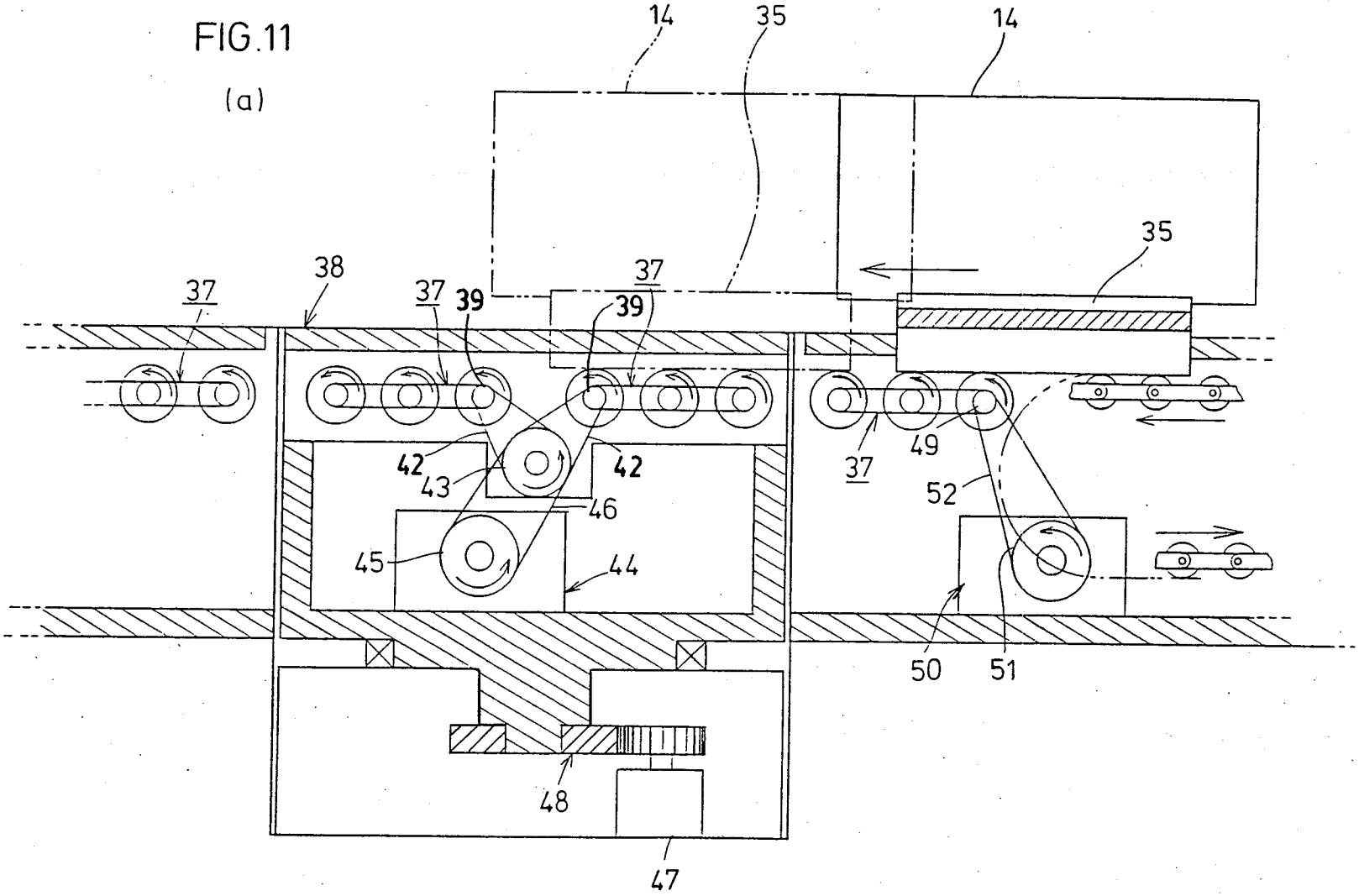
FIG. 11(*a*) shows a vertical cross-sectional view of a portion for relaying a turntable with respective conveyers; whereas FIG. 11(*b*), a vertical cross-sectional view of the turntable.
Figure 11:
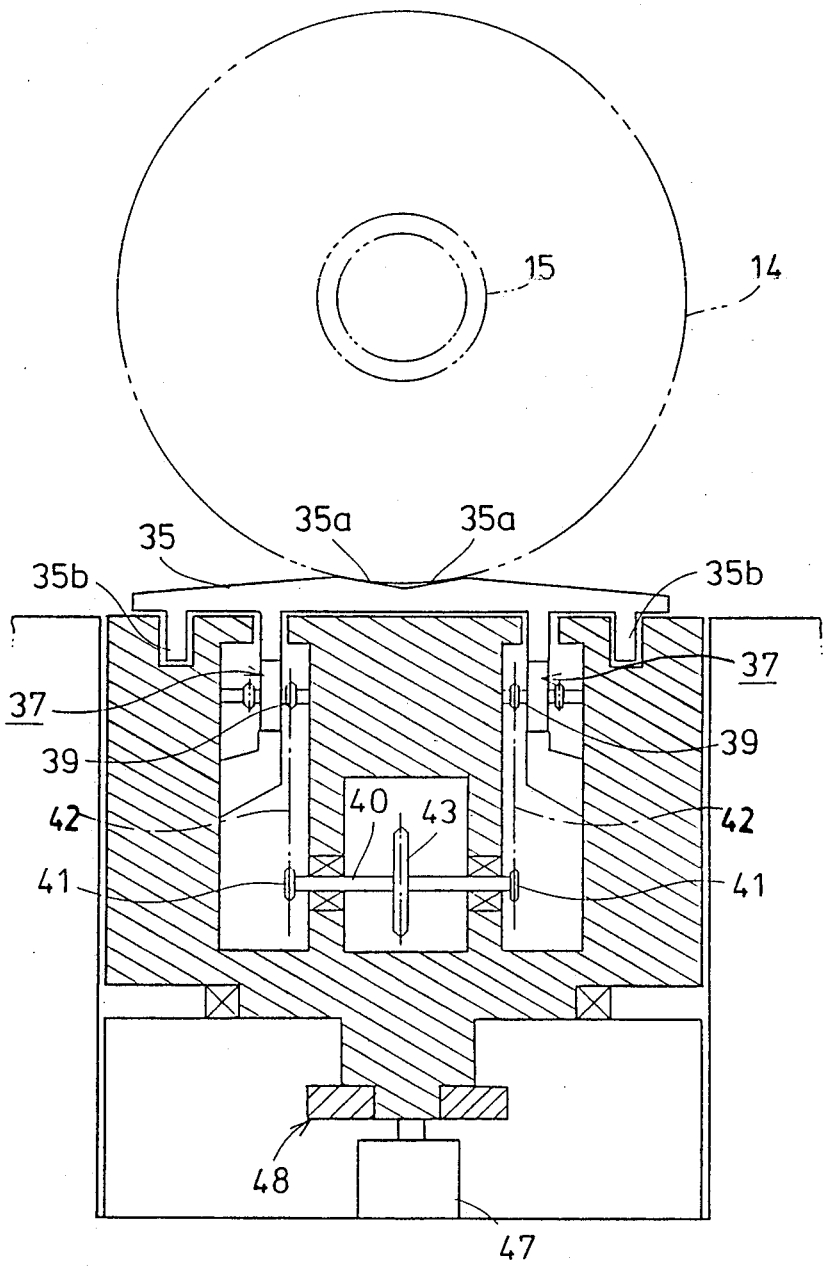

FIGS. 11(*a*) and (*b*) each show a vertical cross-sectional view of the portion for relaying the turntable 38 mentioned above with the respective conveyer EX, $IN_1$ and $IN_2$. Namely, sprockets 39 are disposed along the internal side of the respective roller chains 37. The sprockets 39 are connected to a sprocket 41 fixed to the end of a horizontal rotary shaft 40 by means of a chain 42 extended around them. A sprocket 43 is fixed at the center of the rotary shaft 40, and connected to a sprocket 45 provided in a separate driving mechanism 44 by means of a chain 46 extended around them. The turntable 38 itself having these mechanisms is designed to be turned horizontally to a direction as desired by a motor 47 under engagement of a train of gears 48.

Other roller chains 37 are disposed independent of the above roller chains 37 at the end portion of the line in order to forward the pallet 35 to the turntable 38. Likewise, to these latter roller chains 37 disposed at the line end portion, a sprocket 49 is provided, so that it may be connected to a sprocket 51 provided in a driving mechanism 50 through a chain 52 extended around them. Accordingly, the above roller chains 37 is adapted to be driven independently upon actuation of the driving mechanism 50 so that the pallet 35 may be forwarded to the turntable 38. Incidentally, when the pallet 35 is to be forwarded from the turntable 38 to the conveyer line, the above driving mechanism 50 is driven reversely.

Next, function of the web feeding device according to the so-constituted embodiment will be described referring to the illustration of operation shown in FIGS. 4(*a*) to (*d*) and the flow chart shown in FIG. 5. Preparation steps for loading a web roll 14 to each of the swing arm mechanisms 28 and 29 in the mill roll stand 10 is first described.

It should be noted that in the following description on the function, in order to identify to which of the swing arm mechanisms 28 and 29 (left and right) the swing arms are supported by the shaft in such a way that they may be turned together with said shaft, the left side pair of swing arms are referred to as "left arms" to be distinguished from the right side pair of swing arms as "right arms". Further, referring also to the pallet 35 and lifter 34, (1) members located in the left carry-in conveyer $IN_1$ are defined as "L pallet" and "L lifter", (2) the members located in the intermediate carry-out conveyer EX are defined as "M pallet" and "M lifter", and (3) the members located in the right side carry-in conveyer $IN_2$ are defined as "R pallet" and "R lifter", respectively.

When the splicer 30 is in stand-by posture, a head 30*a* and a head 30*b* in said splicer 30 are open widely to each other in the opposing directions. The left arms 13 provided in the left swing arm mechanism 28 are stopped above the carry-out conveyer EX in a rightwardly tilted posture as shown by the two-dotted chain line in FIG. 4(*a*); whereas the right arms 13 provided in the right swing arm mechanism 29 are likewise stopped in a rightwardly tilted posture.

It is to be understood that while the unloaded M pallet 35, under the above state, is positioned immediately above the lifter 34 in the carry-out conveyer EX, neither the L pallet 35 nor the R pallet 35 has reached any of the positions where the lifter is disposed in the carry-in conveyers $IN_1$ and $IN_2$. The right (left) swing arms 13 are spaced farther from each other along the axis of the shaft so that the center blocks 16 may assume the open posture.

Next, the L pallet 35 loading a web roll 14A thereon travels along the carry-in conveyer $IN_1$ until it reaches the left side of the swing arm mechanism 28 to stop immediately above the L lifter 34 and wait for chucking by the left swing arms 13. In this state, the hydraulic cylinder 25 provided for the swing arm mechanism 28 is actuated to turn the left arms 13 counterclockwise until they assume leftwardly tilted posture above the carry-in conveyer $IN_1$, and where the left arms 13 are stopped. The L lifter 34 is also ascended to bring the paper tube 15 of the web roll 14A loaded on the L pallet 35 to the tips of the center blocks 16. Incidentally, when an unused or little used web roll 14A, whereby having a sufficiently large diameter, is to be chucked, the level of the lifter 34 to be ascended may be smaller correspondingly. Subsequently, the above hydraulic cylinders 23 are actuated synchronously to move the left arms 13 closer to each other to effect chucking of the web roll 14A by the center blocks 16 provided thereon.

During the time when the left arms 13 are in pause above the carry-in conveyer $IN_1$ as described above, the hydraulic cylinder 25 provided for the right swing arm mechanism 29 is actuated, whereby the right arms 13 which are in pause above the carry-in conveyer $IN_2$ are turned counterclockwise and pause above the carry-out conveyer EX in a leftwardly tilted posture. Next, the R pallet 35 loading a web roll 14B travels along the carry-in conveyer $IN_2$ until it reaches the right side of the swing arm mechanism 29 and stops immediately above the R lifter 34 to wait for chucking by the swing arms. In this state, the hydraulic cylinder 25 provided for the swing arm mechanism 29 is actuated to turn the right arms 13 clockwise until they assume a leftwardly tilted posture above the carry-in conveyer $IN_2$, and where the left arms 13 are stopped.

In the above process, provided that the web roll 14B has a reduced diameter after consumption of the web to make chucking of the paper tube 15 infeasible only by the turning of the right arms 13, the R lifter 34 is then actuated to ascend the R pallet 35 together with the web roll 14B to a predetermined level to effect centering of the paper tube 15 of the web roll 14B and the center blocks 16 of the right arms 13. Subsequently, the hydraulic cylinders 23 are actuated synchronously to move the right arms 13 closer to each other and effect chucking of the web roll 14B by the center blocks 16 thereof (see FIG. 4(*a*)).

Further the tail end of the web roll 14A is set to the head 30*a* of the splicer 30; whereas the tail end of the web roll 14B is set to the head 30*b*.

Figure 4:
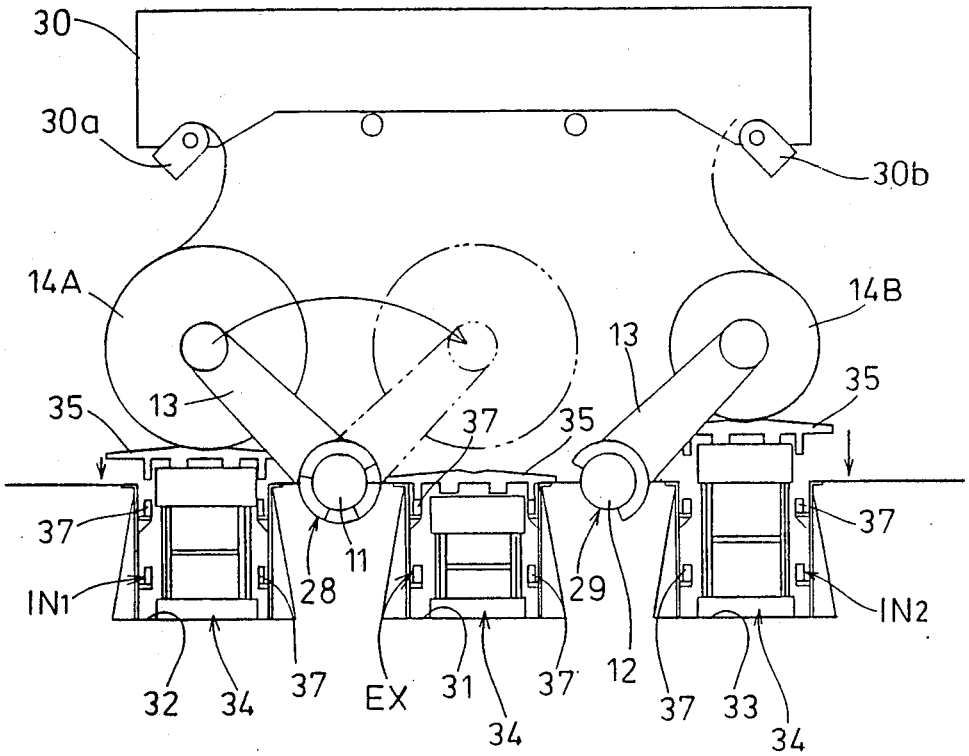
FIGS. 4(*a*) to (*d*) illustrate an operation order with passage of time when the web feeding device shown in FIG. 1 is actuated.
Figure 4:
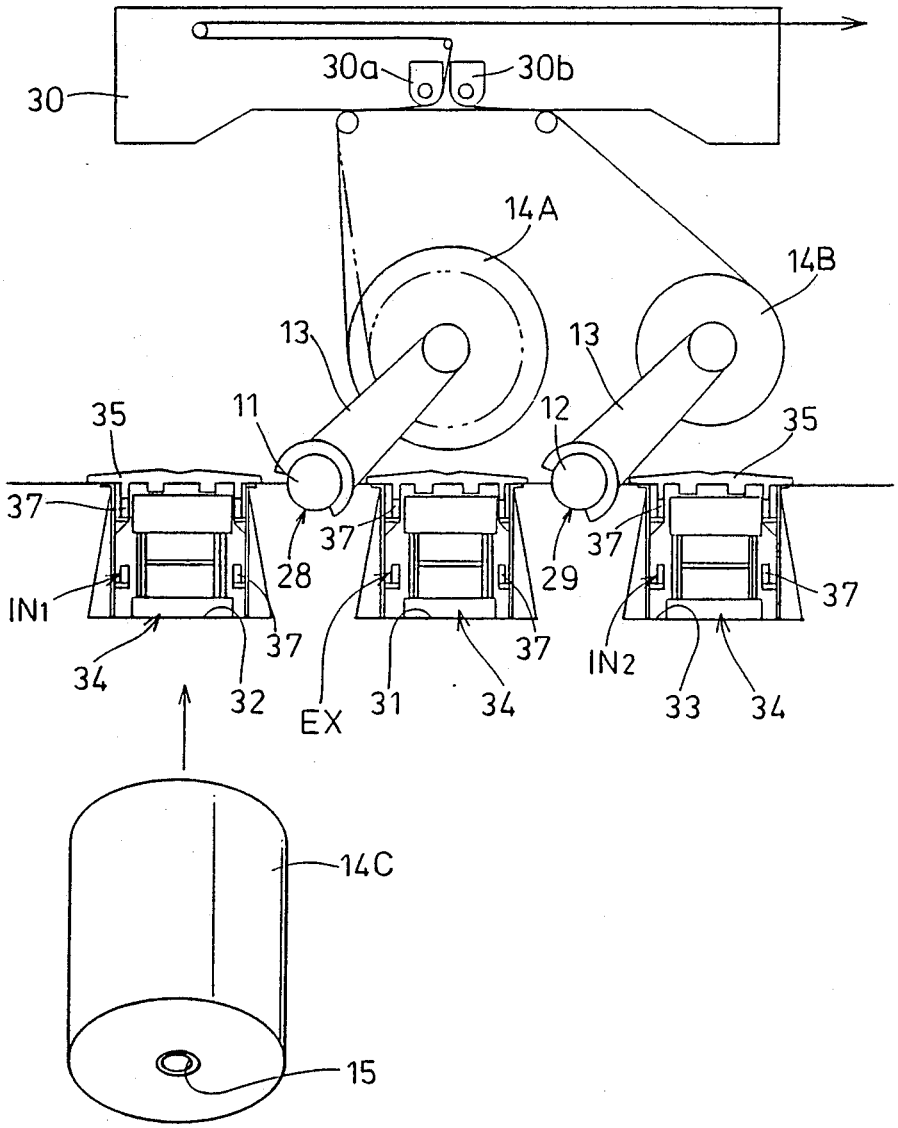
Figure 4:
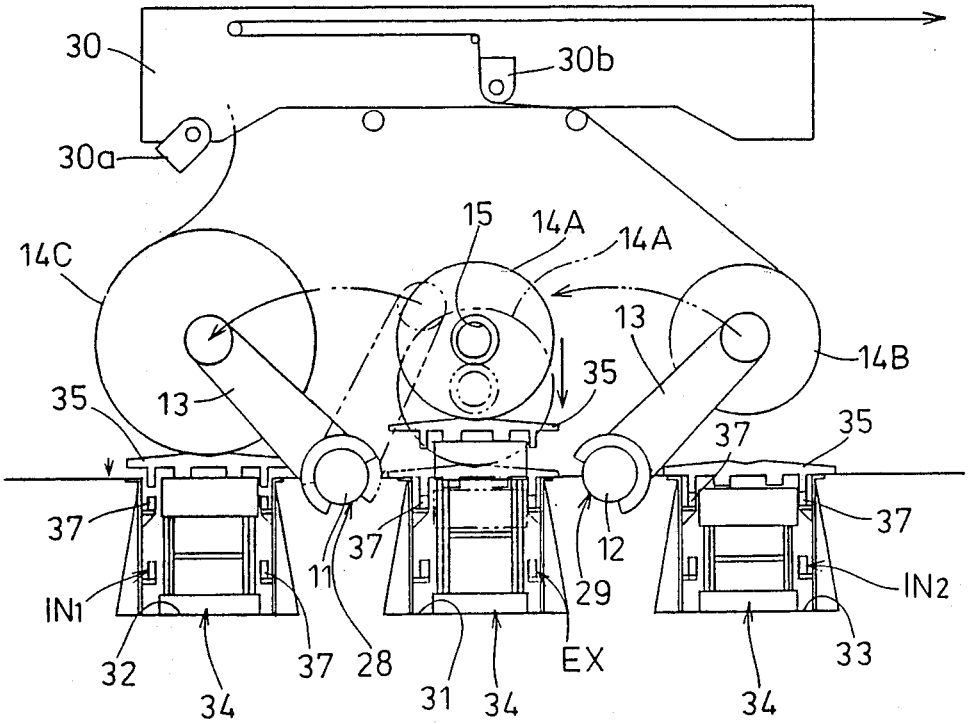
Figure 4:
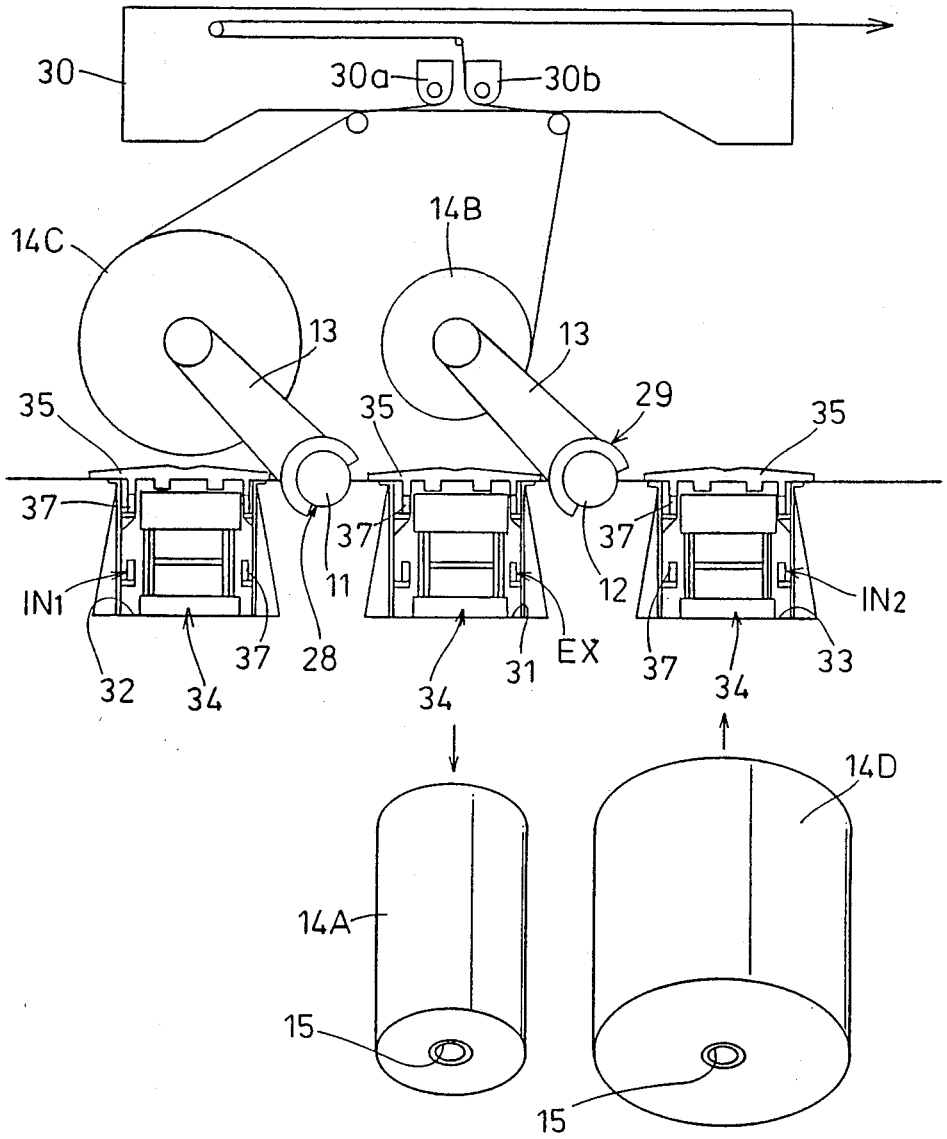
Figure 5:
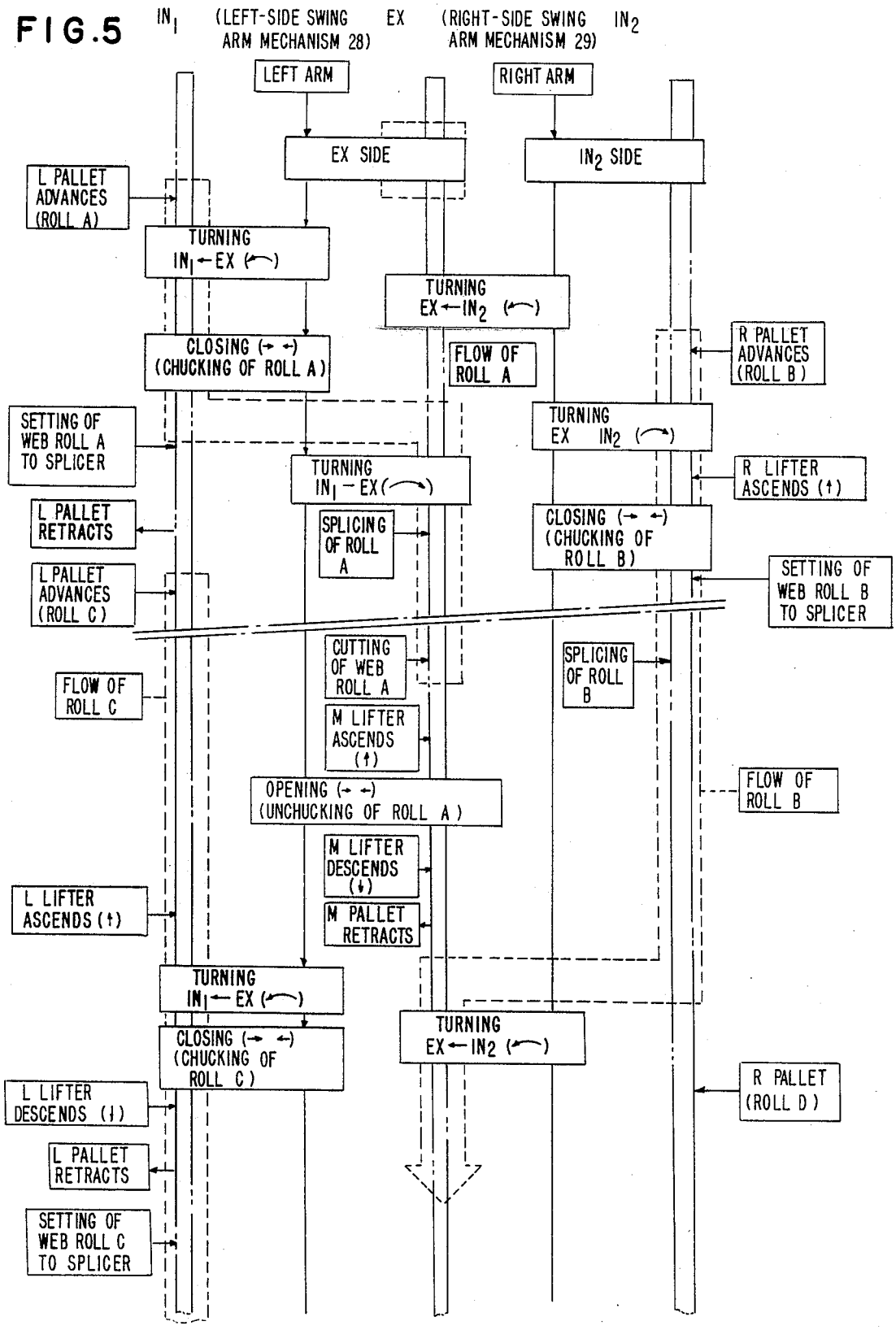
FIG. 5 shows a flow chart with passage of time when the web feeding device shown in FIG. 1 is actuated.

Upon completion of chucking of the web roll 14A and the web roll 14B, the left arms 13 holding the web roll 14A therebetween are turned counterclockwise by actuation of the cylinder 25 reversely, and by allowing said left arms 13 to stop in a rightwardly tilted posture, the web roll 14A can be brought to a position above the carry-out conveyer EX (see FIG. 4(*b*)).

The L pallet 35 in the left carry-in conveyer $IN_1$, having thus unloaded, is retracted from the position where the L lifter is disposed. Further, the heads 30*a* and 30*b* of the splicer 30 are moved closer to each other to achieve splicing of the web delivered from the web roll 14A and feeding to a web consuming mechanism of the corrugator such as a single facer (not shown), as shown in FIG. 4(*b*). An L pallet 35 loading a web roll 14C to be used after the next order travels along the carry-in conveyer $IN_1$ to stop immediately above the L lifter 34 positioned on the left side of the swing arm mechanism 28 and wait for chucking by the swing arms in due order.

Next, description will be made on removal of the web roll 14A in use being loaded onto the left arms 13 for returning it to the stockyard SY, and on replacement of a web roll 14A under loading with a web roll 14B of different standard as mentioned above according to the order change during operation of the corrugator.

First, the web being delivered from the web roll 14A is cut in the splicer 30 to be released from the head 30*a*, and the web from the web roll 14B loaded onto the right arms 13 is spliced by the splicer 30, whereby the web of the web roll 14B is fed to the web consuming mechanism of the corrugator.

Immediately after this splicing, the M lifter 34 disposed in the carry-out conveyer EX is ascended to support the former web roll 14A having a reduced diameter after consumption of the web on the M pallet 35 thereof. The left arms 13 are then moved farther from each other to release chucking by the center blocks 16 against the former web roll 14A. In this state, said M lifter 34 is descended to its lower position again, and the former web roll 14A is carried out together with the M pallet 35 along the carry-out conveyer EX.

Subsequently, the left arms 13 which have released the former web roll 14A are turned counterclockwise and stop in the waiting posture; whereas the web roll 14C having reached the left carry-in conveyer $IN_1$ is ascended by actuation of the L lifter 34 disposed below its waiting position to the chucking position. After alignment of the paper tube 15 of the web roll 14C with the center blocks 16, said left arms 13 are moved closer to each other to effect chucking aginst the web roll 14C. After completion of the chucking against the web roll 14C, the L lifter 34 is descended again and also the L pallet 35 is retracted from this carry-in conveyer $IN_1$ to be prepared for carrying in the next web roll.

The tail end of the web roll 14C to be used in the next order is set to the head 30*a* of the splicer 30 and waits for splicing in the next order. Incidentally, the carry-out conveyer EX is now empty after carrying out of the former web roll 14A. Thus, as shown in FIG. 4(*d*), the right arms 13 loading a new web roll 14B under delivery are turned counterclockwise to shift them to the side of carry-out conveyer EX from the side of carry-in conveyer $IN_2$. Since the carry-in conveyer $IN_2$ will be empty after the above operation, another web roll 14D to be used after the next order is then loaded onto the R pallet 35 and transported along the carry-in conveyer $IN_2$. The operation procedures are then repeated alternatively with respect to the carry-in conveyers $IN_1$ and $IN_2$, in the order as shown in FIG. 4(*b*)→FIG. 4(*c*)→FIG. 4(*d*) →FIG. 4(*b*).

Figure 22:
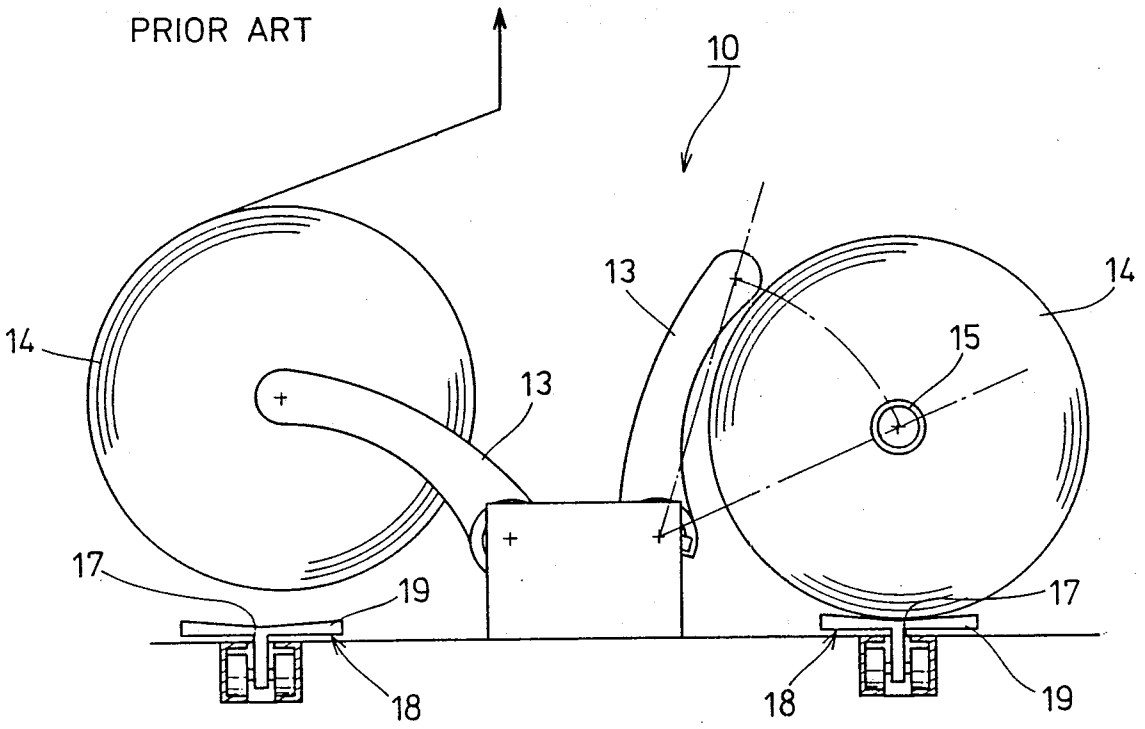
FIG.22 PRIOR ART
FIG. 22 shows schematically a front view of the mill roll stand shown in FIG. 21.

According to the web feeding device of this embodiment, the total time required for removing the web roll in use from the swing arm and chucking a web roll to be used in the next order can considerably be reduced, since the above procedure can be achieved only by turning the swing arms by 90° from the position above the central carry-out conveyer EX to the position above the carry-in conveyer $IN_1$ or $IN_2$, as opposed to the conventional mill roll stand shown in FIG. 22 which require complicated procedures, such as to allow the swing arms having released a web roll onto a conveyer to retract to the original position and then to turn again to be loaded with a new web roll on the same conveyer.

Next, a variation of layout pattern in a factory utilizing the web feeding device shown in FIG. 1 is illustrated in FIG. 6. Such layout pattern can be employed when sufficient space can be secured not only for the operation zone but also the driving zone in a corrugator line. To describe in detail, in the pattern shown in FIG. 6, while the conveyers $IN_1$ and $IN_2$ for carrying in web rolls are both positioned in the operation zone, the carry-out conveyer EX is extended across the driving zone. Accordingly, the driving zone can be utilized as the area for transporting used web rolls 14 so that such used web rolls 14 may successively be transported to the stockyard SY. In this context, stock conveyers SC may be disposed on the side of the carry-out conveyer EX to be in alignment with the corresponding carry-in conveyers $IN_1$ and $IN_2$. In such layout pattern, used web rolls 14 which are to be used again subsequent to the next order can be stocked temporarily in these stock conveyers SC to be returned readily to the carry-in conveyers $IN_1$ and $IN_2$, allowing prompt response to order changes, advantageously.

Moreover, by turning the direction of web rolls by the turntable 38, they can be forwarded to another web feeding device instead of being forwarded to the stockyard SY. Incidentally, web rolls 14 are fed successively to the carry-in conveyers $IN_1$ and $IN_2$ in the operation zone by operators using, for example, a fork lift in proper timing.

FIG. 7 shows another variation of layout pattern in the factory based on the layout pattern shown in FIG. 6, which is an example where a stock conveyer SC is further provided in the operation zone. Namely, a carry-out conveyer EX is extended in the driving zone of the corrugator; whereas in the operation zone opposite to said driving zone a stock conveyer SC comprising a conventionally known slat conveyer for stocking web rolls is disposed in alignment with the above carry-out conveyer EX. In the downstream of the slat conveyer SC, a web roll supplying conveyer is connected thereto.

In the above slat conveyer SC, various types of web rolls 14 are adapted to be stocked thereon for coping with various orders. A used web roll 14, for example, is generally carried out directly to the stockyard SY by means of the above carry-out conveyer EX. However, if the web roll 14 is of a standard which is frequently used, said web roll 14 is retracted to the slat conveyer SC to be stocked thereon. When said web roll 14 is used intrusively, said web roll 14 is forwarded from the slat conveyer SC to the web supplying conveyer. If there is no necessity to stock such web rolls, the slat conveyer SC can be used as an auxiliary carry-in conveyer for carrying in new web rolls for the carry-in conveyers $IN_1$ and $IN_2$.

Figure 12:
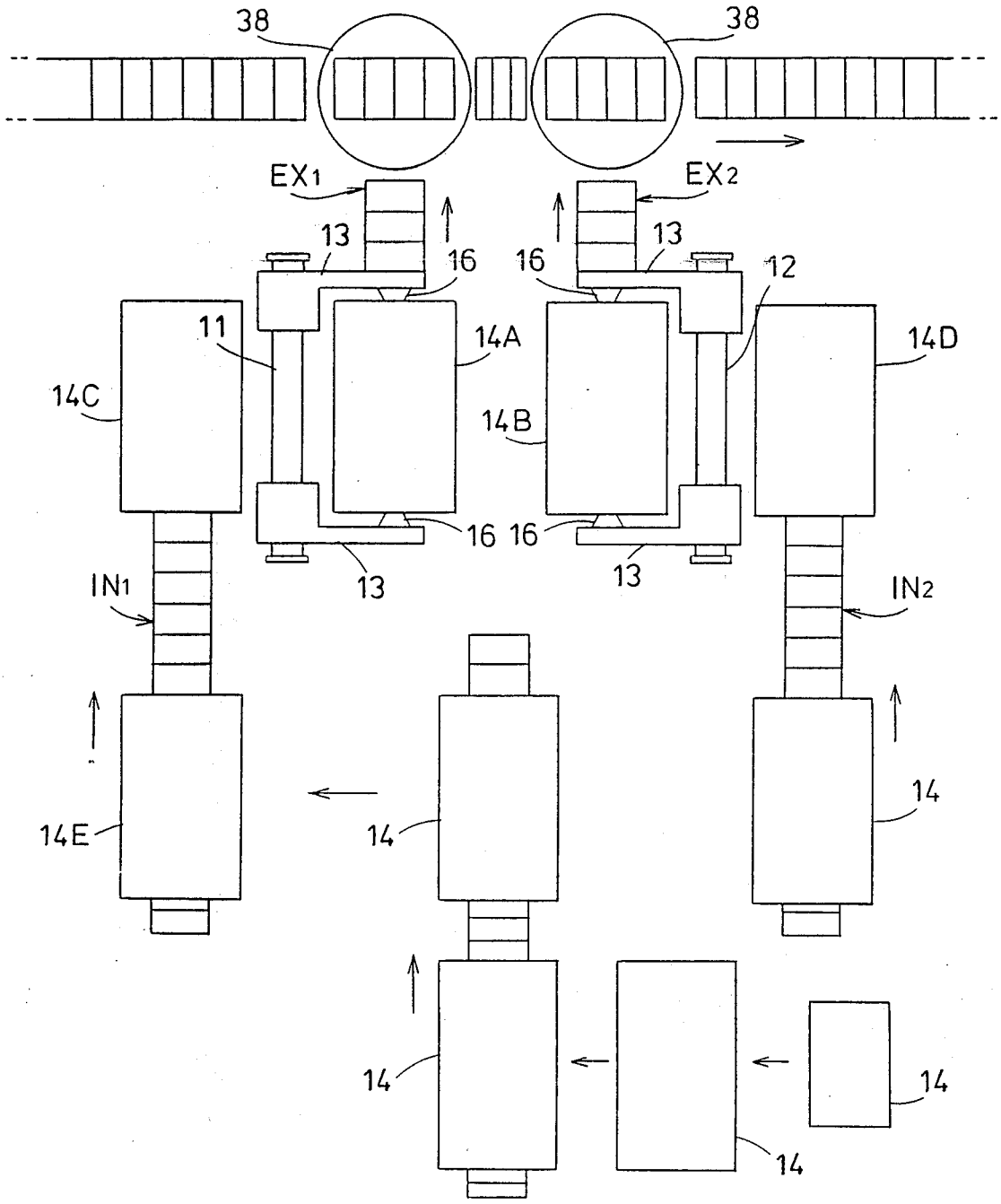
FIG. 12 shows in plan view another exemplary layout pattern when the web feeding device according to this invention is installed in a factory.

FIG. 12 shows an expansive example of layout pattern using the web feeding device according to this invention, i.e. an example in which two carry-in conveyers $IN_1$ and $IN_2$ for carrying in web rolls 14, and two carry-out conveyers $EX_1$ and $EX_2$ are used, respectively. To describe in detail, the two swing arm mechanisms 28 and 29 in the mill roll stand 10 are designed to be disposed adjacent to each other with a larger distance than in the conventional mill roll stand, and two carry-out conveyers $EX_1$ and $EX_2$ are disposed between said two swing arm mechanisms 28 and 29.

At an outer area relative to each of the two pairs of swing arms 13, carry-in conveyers $IN_1$ and $IN_2$ are disposed, respectively. In a layout pattern where two carry-in conveyers $IN_1$ and $IN_2$ and one carry-out conveyer EX are used similarly to the web feeding device shown in FIG. 1, in order to carry in a fifth web roll 14E, it must be in a waiting posture, during the time when a first web roll 14A is carried out; the second web roll 14B and the third web roll 14C are then spliced; the second web roll 14B is carried out; and the third web roll 14 is carried onto the carry-out line. However, according to the layout pattern shown in FIG. 12, the fifth web roll 14E can advantageously be carried in requiring substantially no waiting time, since the third web roll 14C can be carried onto the carry-out line, after the first web roll 14A is carried out, irrespective of the motions of the second web roll 14B and the fourth web roll 14D.

Figure 13:
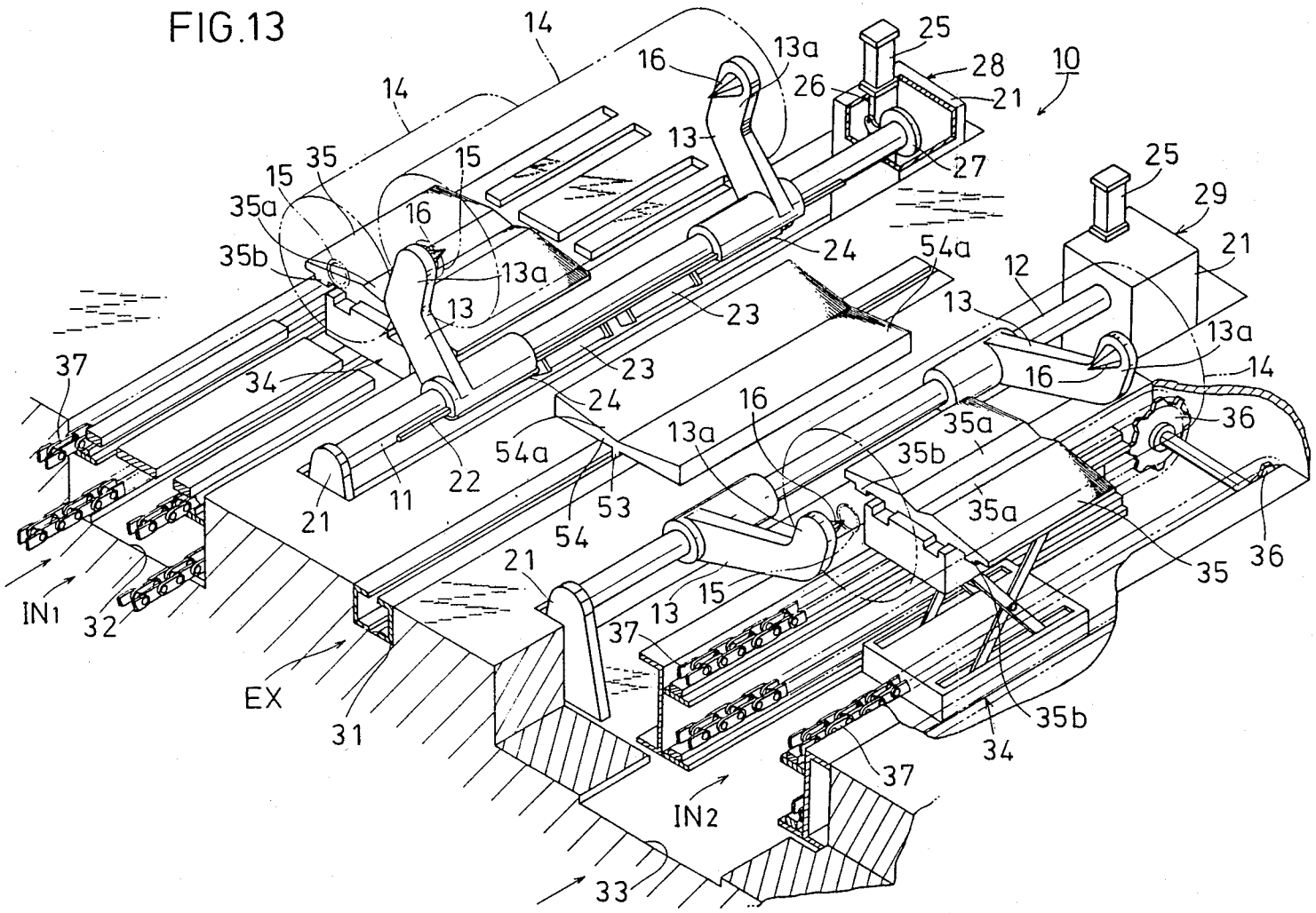
FIG. 13 shows schematically a perspective view of the web feeding device according to another embodiment of this invention.

FIG. 13 shows a variation of the web feeding device shown in FIG. 1. In the web feeding device shown in FIG. 1, the lifter 34 is used in any of the carry-in conveyers $IN_1$ and $IN_2$ and the carry-out conveyer EX. However, the greater the number of the lifter 34 is, the higher may be the production cost. Further, the use of the lifters 34 naturally require use of free flow mode conveyers wherein the pallets 35 can be separated from the roller chains 37. For such reasons, in the web feeding device shown in FIG. 13, the lifter 34 is used only in the carry-in conveyers $IN_1$ and $IN_2$, respectively, and the constitution of these conveyers $IN_1$ and $IN_2$ is designed to be of the abovementioned free flow mechanism, whereas a conventional slat conveyer is used for the conveyer EX for carrying out the web rolls 14.

It should be noted, however, that if swing arms 13 having a shape as shown in FIG. 1 are used in the above constitution a gap between the level of the web roll 14 and that of the slat conveyer may be big to generate a larger shock disadvantageously when the chucking against the used web roll 14 is released from the swing arms 13 onto the slat conveyer. Therefore, free end portions 13*a* of the respective swing arms 13 are bent toward the carry-out conveyer EX with a predetermined off-set angle, such that the gap between the level of the flat car 53 on the carry-out conveyer 53 and that of said web roll 14 may be minimal to prevent generation of greater shock.

Figure 14:
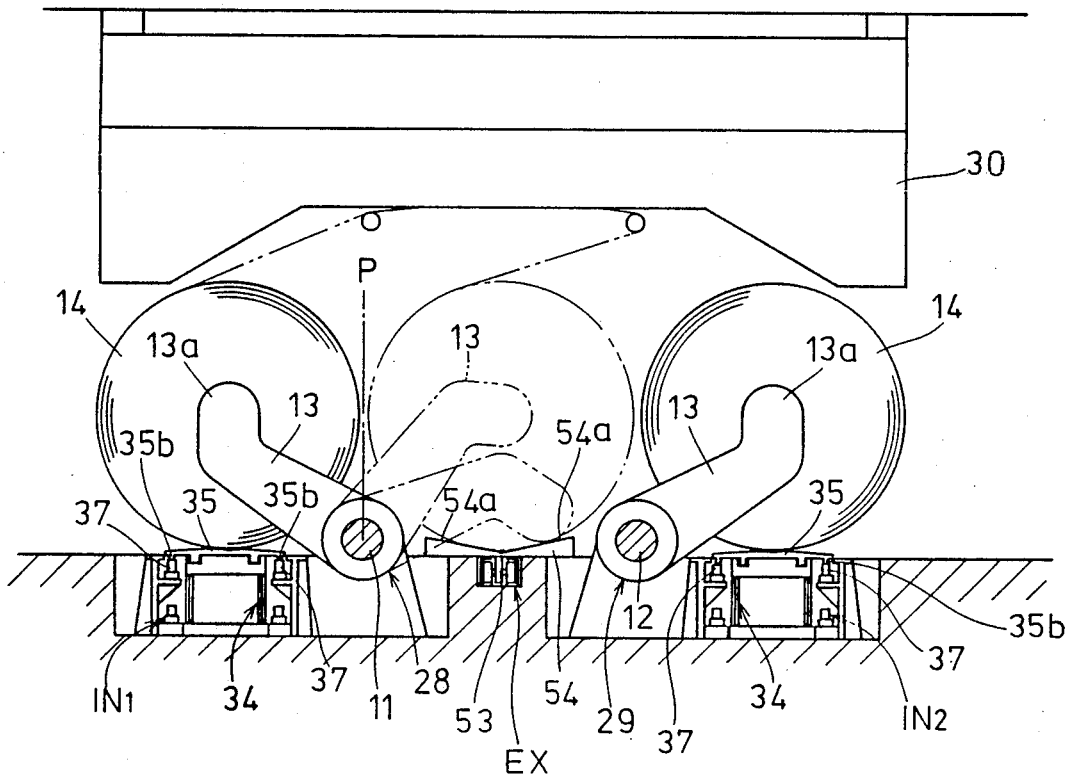
FIG. 14 is a front view of the web feeding device shown in FIG. 13 disposed below a splicer.

The mill roll stand 10 shown in FIG. 13 is disposed below a known splicer 30 which performs splicing of webs as shown in FIG. 14. On the floor of the factory site where such splicer 30 and the above mill roll stand 10 as well are installed, three pits each having a predetermined depth are defined parallel to the pivotal shafts 11 and 12 each supporting thereon swing arms 13 (in the orthogonal direction relative to the line of feeding webs). Namely, at a position intermediate between the two pivotal shafts 11 and 12 each constituting the swing arm mechanism 28 or 29 in the above mill roll stand 10, a first pit 31 is defined for disposing a web roll carry-out conveyer EX to be housed therein.

This carry-out conveyer EX is a slat conveyer, and a flat car 53 is provided in the pit 31 such that the flat car 53 may run freely there along. The flat car 53 has a table 54 for loading web rolls thereon, having two slant planes 54*a* on the top surface to form a V-shaped cross-section, and only this table 54 appears above the pit. Incidentally, the slant planes 54*a* formed on the table 54 serve to guide a used web roll 14 to the center of the flat car 53 when said roll 14 is released from the swing arm mechanism 28 (29), as will be described later.

A second pit 32 and a third pit 33 are formed parallel to the first pit 31 at outer areas relative to the pivotal shafts 11 and 12 in said two swing arm mechanisms 28 and 29, respectively. A web roll carry-in conveyer $IN_1$ is disposed to be housed in the second pit 32; whereas a web roll carry-in conveyer $IN_2$, in the third pit 33.

The carry-in conveyers $IN_1$ and $IN_2$ for carrying in web rolls 14 to be used herein are a kind of free flow conveyer of the same constitution as described referring to FIG. 8. As shown in FIG. 14, the pallet 35 is removably mounted on a pair of endless roller chains 37 so that the former can be carried along the latter. The above pallet 35; the constitution where the pallet 35 is removably mounted on the roller chains 37 each constituting the conveyer driving system of the conveyer $IN_1$ and $IN_2$; and the constitution where ascending and descending of the pallet 35 is performed by the pantographic lifter 34 disposed relative to each pit 32 or 34 can likewise be explained by the description made referring to FIGS. 8 and 9. As for the functions, when the lifter 34 is ascended, the lifter is first brought into contact upwardly with the bottom surface of the pallet 35 mounted on the roller chains 37 and positioned adjacent to the mill roll stand 10, and then said pallet 35 is separated from the conveyer driving system to be ascended to a predetermined level (see FIG. 15(*a*)). When the driving source mentioned before is driven reversely, the lifter 34 descends to mount the pallet 35 again stably on the roller chains 37 which constitute the conveyer driving system and further descends until it reaches a predetermined position to stop there (see FIG. 15(*b*)).

Accordingly, when the swing arms 13 are turned to a position above the carry-in conveyer $IN_1$ ($IN_2$), a web roll 14 loaded on the pallet 35 is ascended to a predetermined level, whereby centering of the paper tube 15 of said web roll 14 with the opposing center blocks 16 of the swing arms 13 can be effected.

Each pair of swing arms 13 of the swing arm mechanisms 28 and 29 are swung upward to a position above the carry-out conveyer EX after chucking the web roll 14 supplied onto the carry-in conveyer $IN_1$ ($IN_2$). After completion of web feeding at this position, replacement with a new web roll 14 can be achieved by releasing the used former web roll 14 above said carry-out conveyer EX onto the flat car 53.

Figure 16:
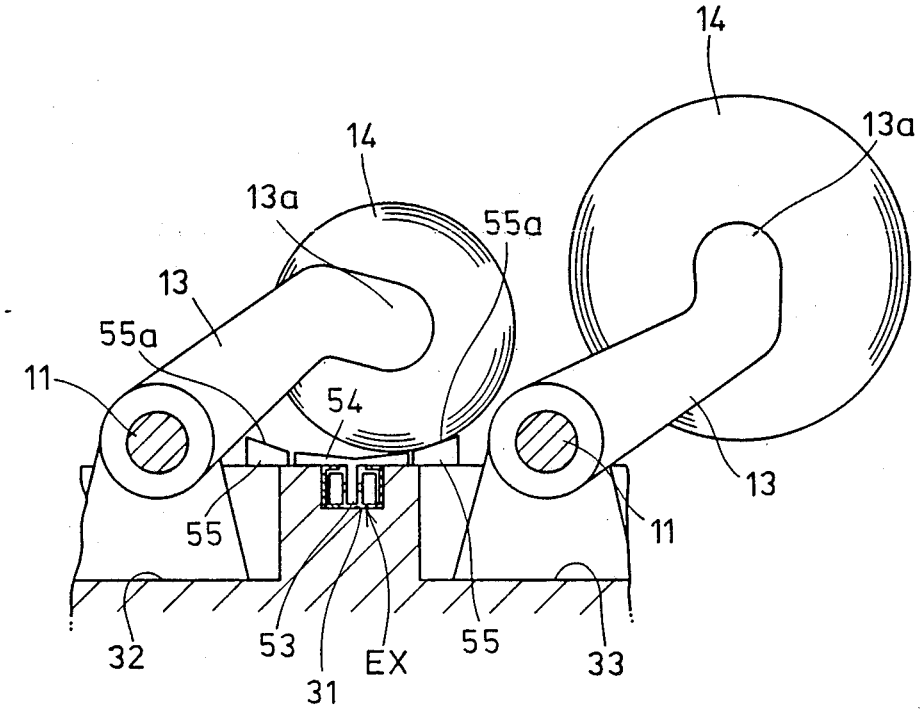
FIG. 16 shows schematically, in front view a major portion of a variation of the embodiment shown in FIG. 13.

Next, FIG. 16 shows a variation of the device shown in FIG. 13, wherein a pair of guide members 55 on each of which a guide surface 55*a* declining toward the carry-out conveyer EX is formed are extended with a predetermined length parallel to the carry-out conveyer EX above the level of the floor of the factory site each at a position between the pit 31, in which the carry-out conveyer EX is disposed, and the swing arm mechanism 28 or 29, respectively. The table 54 of the above flat car 53 is designed to have dimensions such that it can pass through the space defined between said two guide members 55. Namely, in releasing the used web roll 14 onto the flat car 53, said web roll 14 is directed to the table 54 of the flat car 53 guided by the guide surfaces 55*a* formed on the guide members 55.

Figure 17:
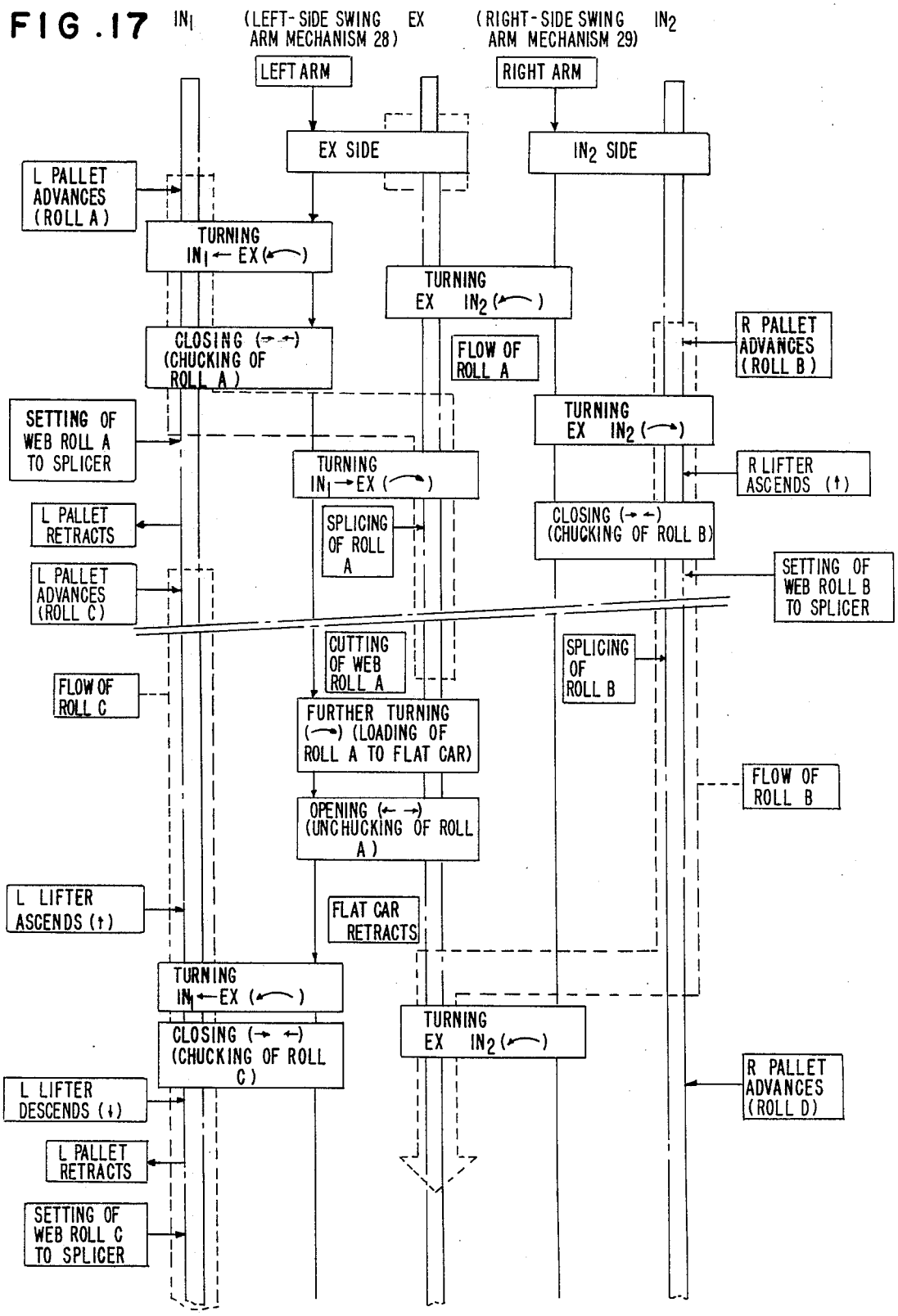
FIG. 17 shows a flow chart with passage of time when the web feeding device shown in FIG. 13 is actuated.

Function of the web feeding device according to such constitution will now be described referring to the illustration of actions shown in FIG. 15(*a*) to (*d*) and the flow chart shown in FIG. 17.

When the splicer 30 is in stand-by posture, a head 30*a* and a head 30*b* in said splicer 30 are open widely to each other in the opposing directions. The left arms 13 provided in the left swing arm mechanism 28 are in pause above the carry-out conveyer EX in a rightwardly tilted posture as shown by the two-dotted chain line in FIG. 15(*a*); whereas the right arms 13 provided in the right swing arm mechanism 29 are likewise in pause in a rightwardly tilted posture. It should be understood that in such a state, while an unloaded flat car 53 is present on the carry-out conveyer EX, neither the L pallet 35 nor the R pallet 35 has not reached the carry-in conveyers $IN_1$ and $IN_2$ at the position where the lifter is provided, respectively. Each pair of arms 13 are spaced farther from each other along the axis of the shaft so that the center blocks 16 may assume the open posture.

Next, the L pallet 35 loading a web roll 14A thereon travels along the carry-in conveyer $IN_1$ until it reaches the left side of the swing arm mechanism 28 to stop immediately above the L lifter 34 and wait for chucking by the left swing arms 13. In this state, the hydraulic cylinder 25 provided for the swing arm mechanism 28 is actuated to turn the left arms 13 counterclockwise until they assume a leftwardly tilted posture above the carry-in conveyer $IN_1$, and there the left arms 13 are stopped. The L lifter 34 is also ascended to bring the paper tube 15 of the web roll 14A loaded on the L pallet 35 to the tips of the center blocks 16. Incidentally, when a web roll 14A has a sufficiently large diameter, for such reason as it is unused or little used, is to be chucked, the level of the lifter 34 to be ascended may be smaller correspondingly. Subsequently, the above hydraulic cylinders 23 are actuated synchronously to move the left arms 13 closer to each other to effect chucking of the web roll 14A by the center blocks 16 provided thereon.

During the time when the left arms 13 are in pause above the carry-in conveyer $IN_1$ as described above, the hydraulic cylinder 25 provided for the right swing arm mechanism 29 is actuated, whereby the right arms 13 which are in pause above the carry-in conveyer $IN_2$ are turned counterclockwise and pause above the carry-out conveyer EX in a leftwardly tilted posture. Next, the R pallet 35 loading a web roll 14B travels along the carry-in conveyer $IN_2$ until it reaches the right side of the swing arm mechanism 29 and stops immediately above the R lifter 34 to wait for chucking by the swing arms. In this state, the hydraulic cylinder 25 provided for the swing arm mechanism 29 is actuated to turn the right arms 13 clockwise until they assume a rightwardly tilted posture above the carry-in conveyer $IN_2$, and where the right arms 13 are stopped.

In the above process, provided that the web roll 14B has a reduced diameter after consumption of the web to make chucking of the paper tube 15 infeasible only by the turning of the right arms 13, the R lifter 34 is then actuated to ascend the R pallet 35 together with the web roll 14B to a predetermined level to effect centering of the paper tube 15 of the web roll 14B with the center blocks 16 of the right arms 13. Subsequently, the hydraulic cylinders 23 are actuated synchronously to move the right arms 13 closer to each other and effect chucking of the web roll 14B by the center blocks 16 thereof (see FIG. 15(*a*)).

Further, the tail end of the web roll 14A is set to the head 30*a* of the splicer 30; whereas the tail end of the web roll 14B is set to the head 30*b*.

Figure 15:
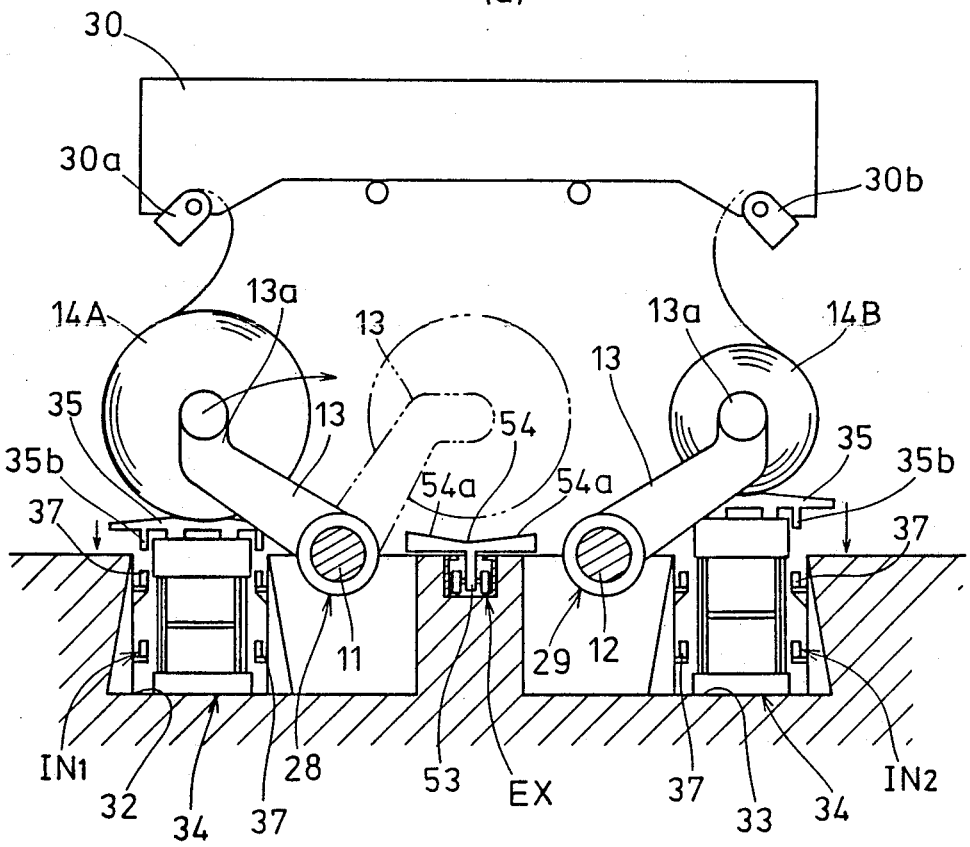
FIGS. 15 (*a*) to (*d*) illustrate an operation order with passage of time when the web feeding device shown in FIG. 13 is actuated.
Figure 15:
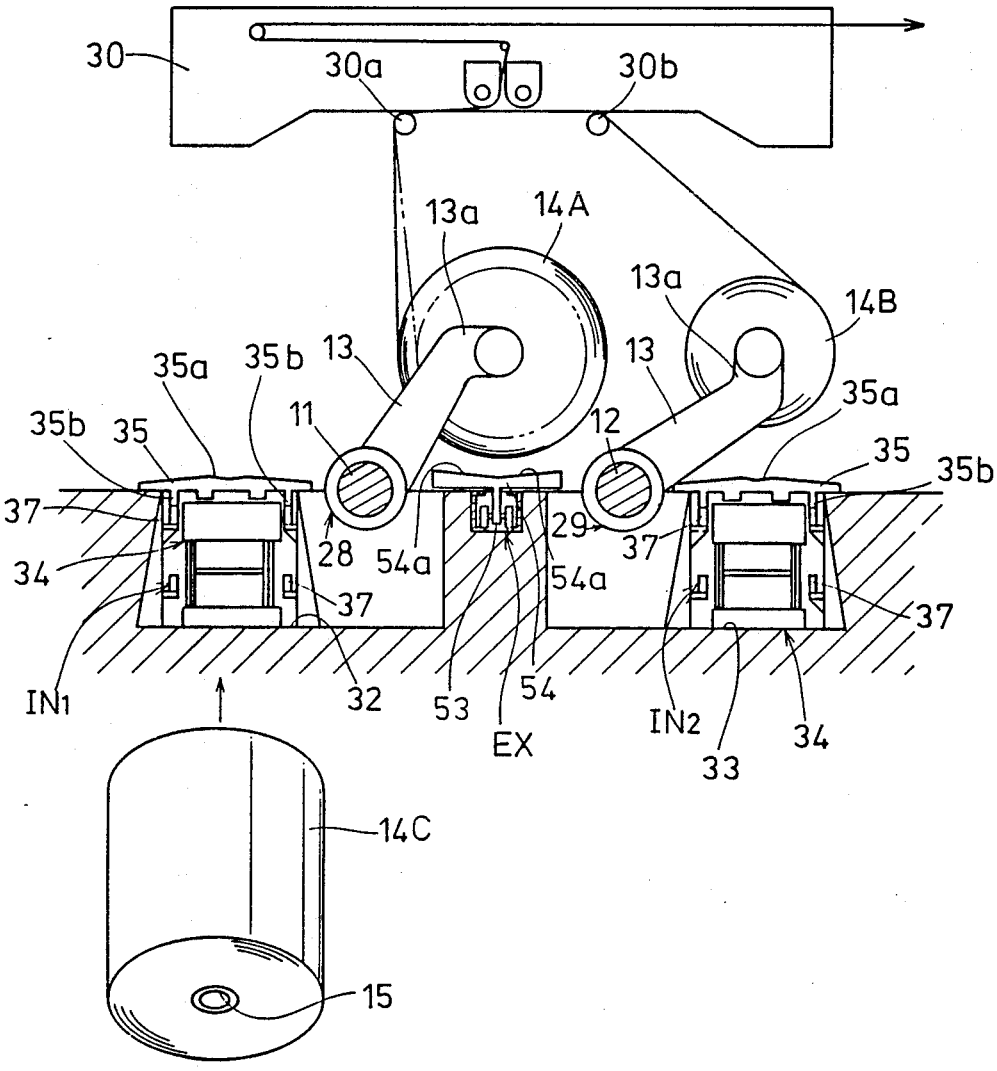
Figure 15:
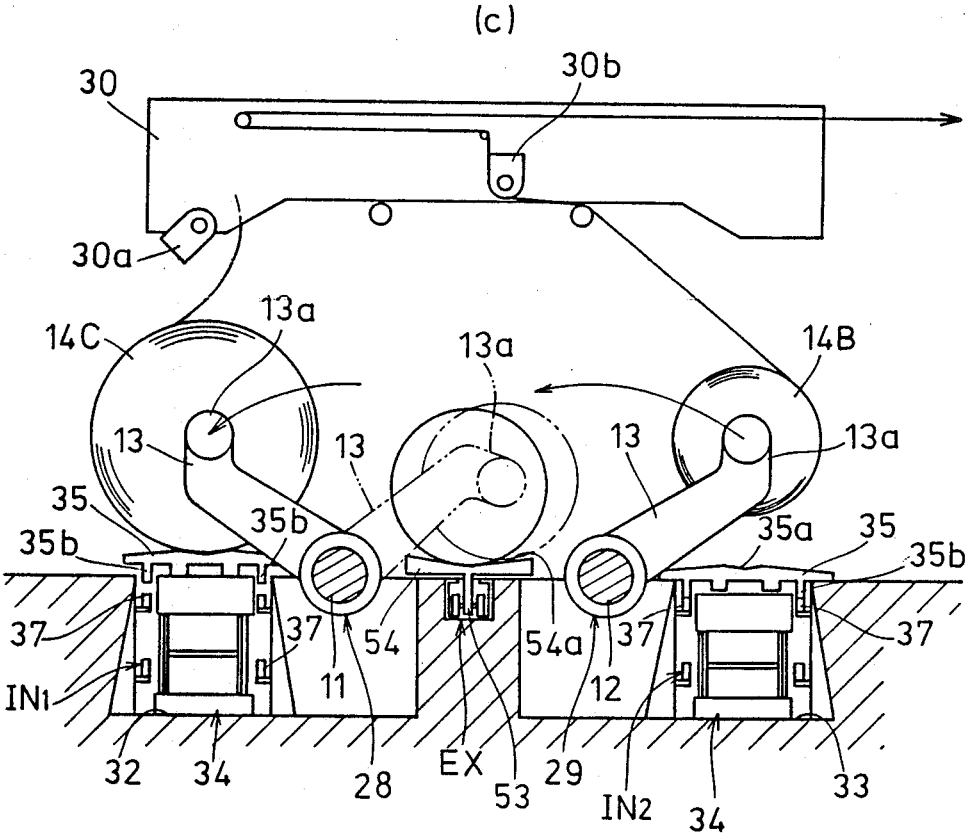
Figure 15:
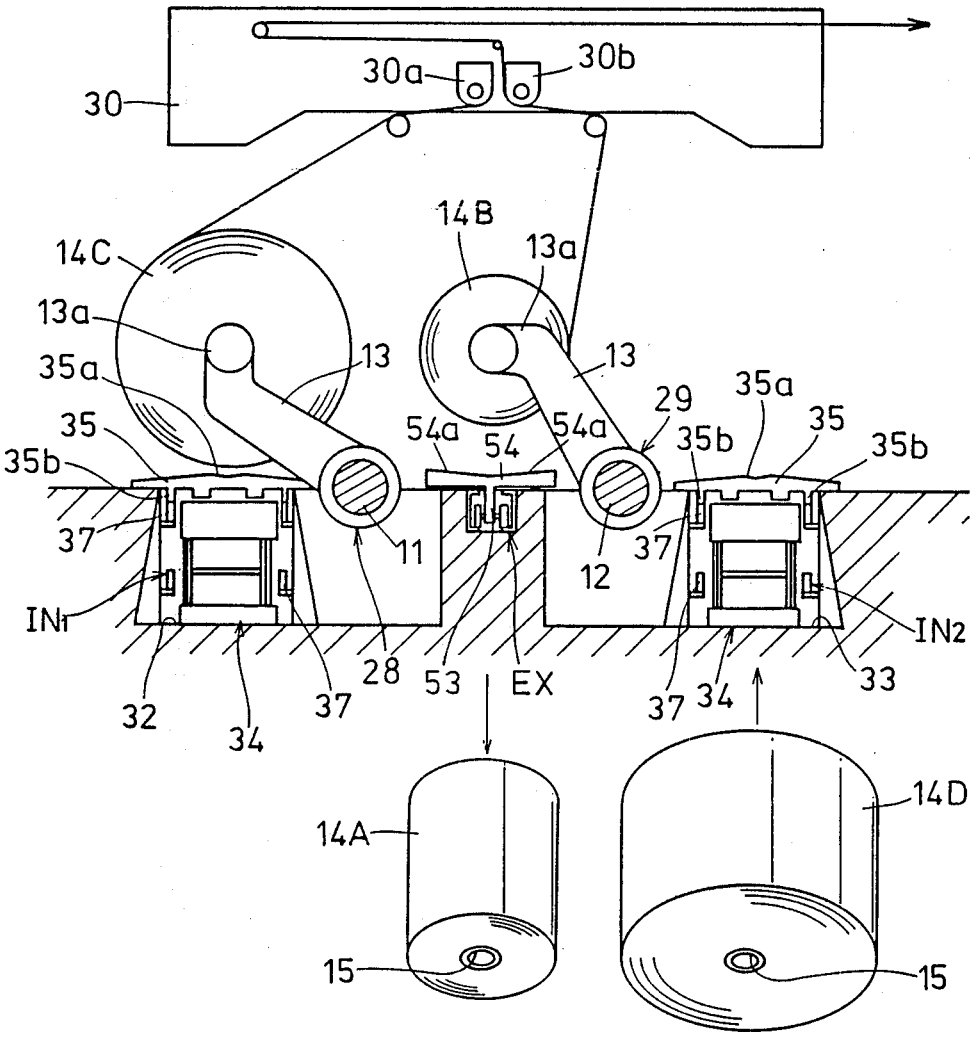

Upon completion of chucking against the web roll 14A and the web roll 14B, the left arms 13 holding the web roll 14A therebetween are turned clockwise by actuation of the cylinder 25 reversely, and by allowing said left arms 13 to stop in a rightwardly tilted posture, the web roll 14A can be brought to a position above the carry-out conveyer EX (see FIG. 15(*b*)).

The L pallet 35 in the left carry-in conveyer $IN_1$, having been thus unloaded, is retracted from the position where the L lifter is disposed. Further, the head 30*a* and 30*b* of the splicer 30 are moved closer to each other to achieve splicing of the web delivered from the web roll 14A and feeding to a web consuming mechanism of the corrugator such as a single facer (not shown), as shown in FIG. 15(*b*). An L pallet 35 loading a web roll 14C to be used after the next order travels along the carry-in conveyer $IN_1$ to stop immediately above the L lifter 34 positioned on the left side of the swing arm mechanism 28 and wait for chucking by the swing arms in due order.

Next, description will be made on removal of the web roll 14A in use being loaded onto the left arms 13 for returning it to the stockyard SY, and on replacement of a web roll 14A under loading with a web roll 14B of different standard as mentioned above according to the order change during operation of the corrugator.

First, the web being delivered from the web roll 14A is cut in the splicer 30 to be released from the head 30*a*, and the web from the web roll 14B loaded onto the right arms 13 is spliced by the splicer 30, whereby the web of the web roll 14B is fed to the web consuming mechanism of the corrugator.

Immediately after this splicing, the left arms 13 are turned clockwise to bring the former web roll 14A having a reduced diameter after consumption of the web to a position above the flat car 53; wherein the distance between said web roll 14A and the flat car 53 can be minimized, since the free ends 13*a* of the arms 13 are bent toward the carry-out conveyer EX (see FIG. 15(*c*)). By moving the left arms 13 farther from each other, chucking by the center blocks 16 against the former web roll 14A can be released. The former web roll 14A is thus dropped onto the flat car 53 and carried out as loaded on the flat car 53 along the carry-out conveyer EX. The former web roll 14A dropped onto the table 54 of the flat car 53 is guided to the center of the flat car 53 to be loaded thereon stably, since slant planes 54*a* are formed on the table 54 of said flat car 53.

Subsequently, the left arms 13 which have released the former web roll 14A are turned counterclockwise to stop in the waiting posture; whereas the web roll 14C having reached the left carry-in conveyer $IN_1$ is ascended by actuation of the L lifter 34 disposed below its waiting position to the chucking position. After alignment of the paper tube 15 of the web roll 14C with the center blocks 16, said left arms 13 are moved closer to each other to effect chucking against the web roll 14C. After completion of the chucking against the web roll 14C, the L lifter 34 is descended again and also the L pallet 35 is retracted from this carry-in conveyer $IN_1$ to be prepared for carrying in the next web roll.

The tail end of the web roll 14C to be used in the next order is set to the head 30*a* of the splicer 30 and waits for splicing in the next order. Incidentally, the carry-out conveyer EX is now empty after carrying out of the former web roll 14A. Thus, as shown in FIG. 15(*d*), the right arms 13 loading a new web roll 14B under delivery are turned counterclockwise to shift them to the side of carry-out conveyer EX from the side of carry-in conveyer $IN_2$. Since the carry-in conveyer $IN_2$ will be empty after the above operation, another web roll 14D to be used after the next order is then loaded onto the R pallet 35 and brought onto the carry-in conveyer $IN_2$. The operation procedures are then repeated alternatively with respect to the carry-in conveyers $IN_1$ and $IN_2$, in the order as shown in FIG. 15(*b*)→FIG. 15(*c*)→FIG. 15(*d*)→FIG. 15(*b*).

Figure 18:
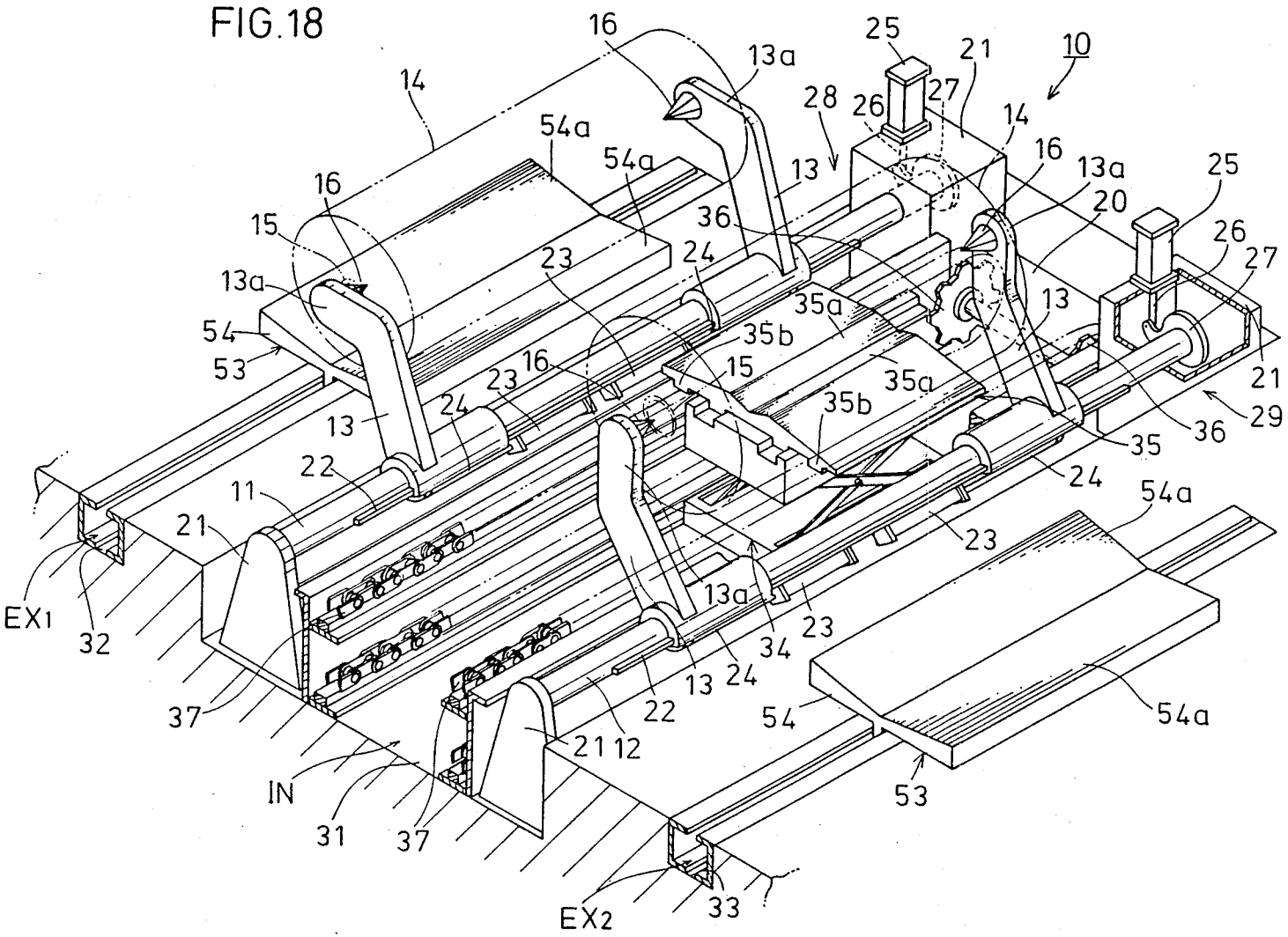
FIG. 18 shows schematically a perspective view of the web feeding device according to another embodiment of this invention.

Next, a device of an arrangement in which the arrangement of the device shown in FIGS. 13 to 17 has been reversed will be shown in FIG. 18. To describe in detail, a carry-in conveyer IN is designed to be disposed intermediate between the two swing arm mechanisms 28 and 29; whereas carry-out conveyers $EX_1$ and $EX_2$ are designed to be disposed at outer areas relative to said swing arm mechanisms 28 and 29, respectively. Accordingly, one lifter 34 is enough to be used only in the carry-in conveyer IN. Further, the conveyers of free flow system on which the pallet 35 is removably placed may be provided only for the carry-in conveyer IN, contributing greatly to the reduction of the entire production cost.

Figure 19:
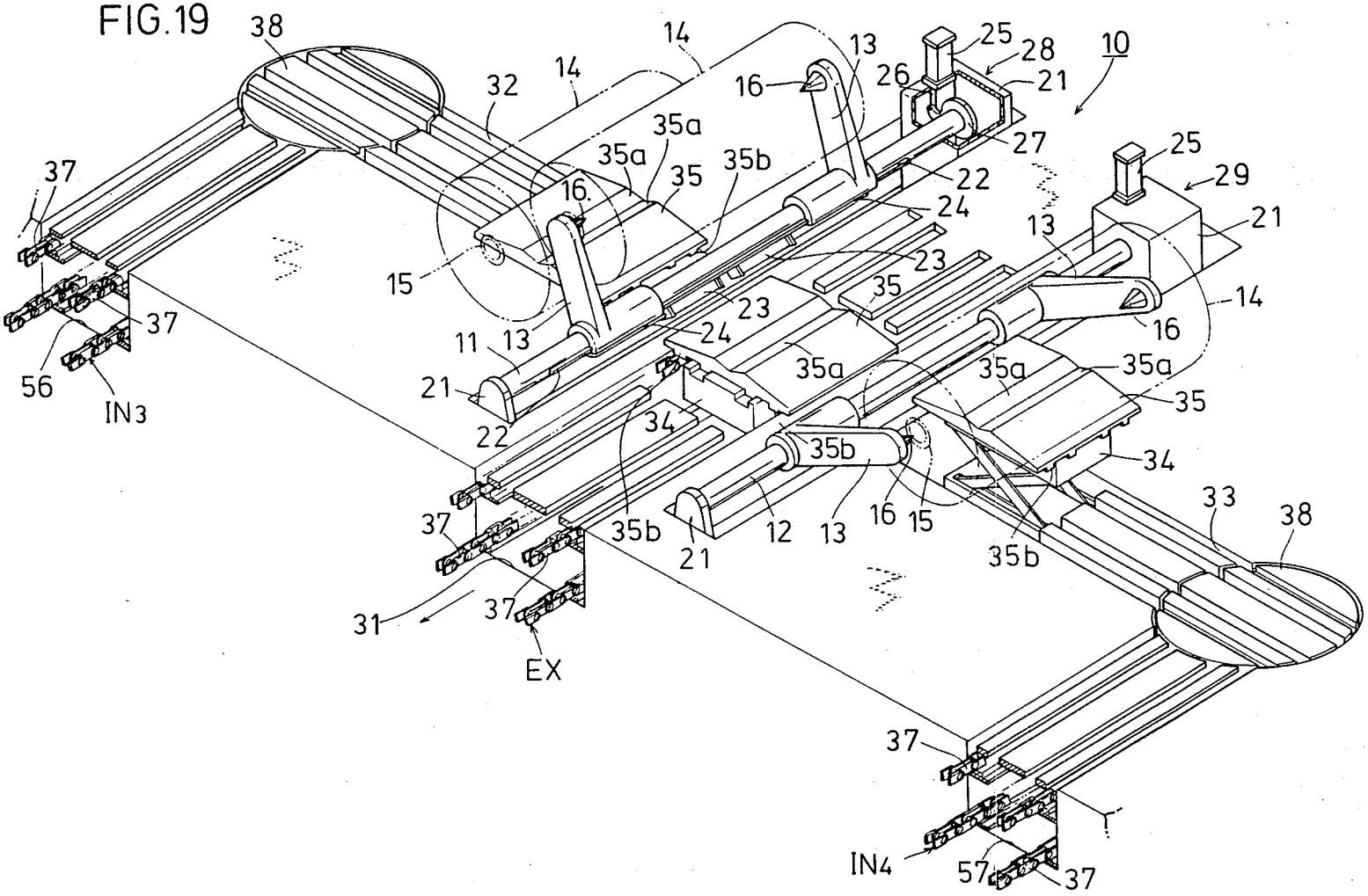
FIG. 19 further shows schematically a perspective view of the web feeding device according to another embodiment of this invention.

FIG. 19 shows another embodiment of the web feeding device according to this invention; wherein the web roll transporting conveyers disposed at outer areas relative to the two swing arm mechanisms 28 and 29, respectively, are disposed so that they may be orthogonal with the pivotal shafts 11 and 12 of the respective swing arm mechanisms 28 and 29. The constitution of the swing arm mechanisms 28 and 29 themselves should be understood to be the same as described referring to FIGS. 1 and 2. Namely, a first pit 31 is defined intermediate between the two pivotal shafts 11 and 12 constituting the swing arm mechanisms 28 and 29, respectively, in the mill roll stand 10 parallel to said pivotal shaft 11 and 12 (in the orthogonal direction relative to the line of feeding web rolls), and the web roll carry-out conveyer EX is adapted to be disposed in the first pit 31 to be housed therein.

A second pit 32 and a third pit 33 are defined at outer areas relative to said pivotal shafts 11 and 12 of the two swing arm mechanisms 28 and 29, respectively, to extend orthogonal with the pivotal shafts 11 and 12 (parallel to the line of feeding webs) of the two swing arm mechanisms 28 and 29 starting from the central position relative to said pivotal shafts 11 and 12 and below the swinging loci of the swing arms 13. A web roll carry-in conveyer $IN_1$ is disposed to be housed in the second pit 32; whereas a web roll carry-in conveyer $IN_2$, in the third pit 33. To the second pit 32 and the third pit 33, a fourth pit 56 and a fifth pit 57 are connected, respectively, to extend parallel to the above first pit 31. A web roll carry-in conveyer $IN_3$ is disposed to be housed in the fourth pit 56; whereas a web roll carry-in conveyer $IN_4$, in the fifth pit 57. At the junction of the second pit 32 (third pit 33) with the fourth pit 56 (fifth pit 57) a known turntable 38 is disposed, so that the direction of the web roll 14 transported by the carry-in conveyer $IN_3$ ($IN_4$) may be turned by 90° to be forwarded to the swing arm mechanism 28 (29).

Figure 20:
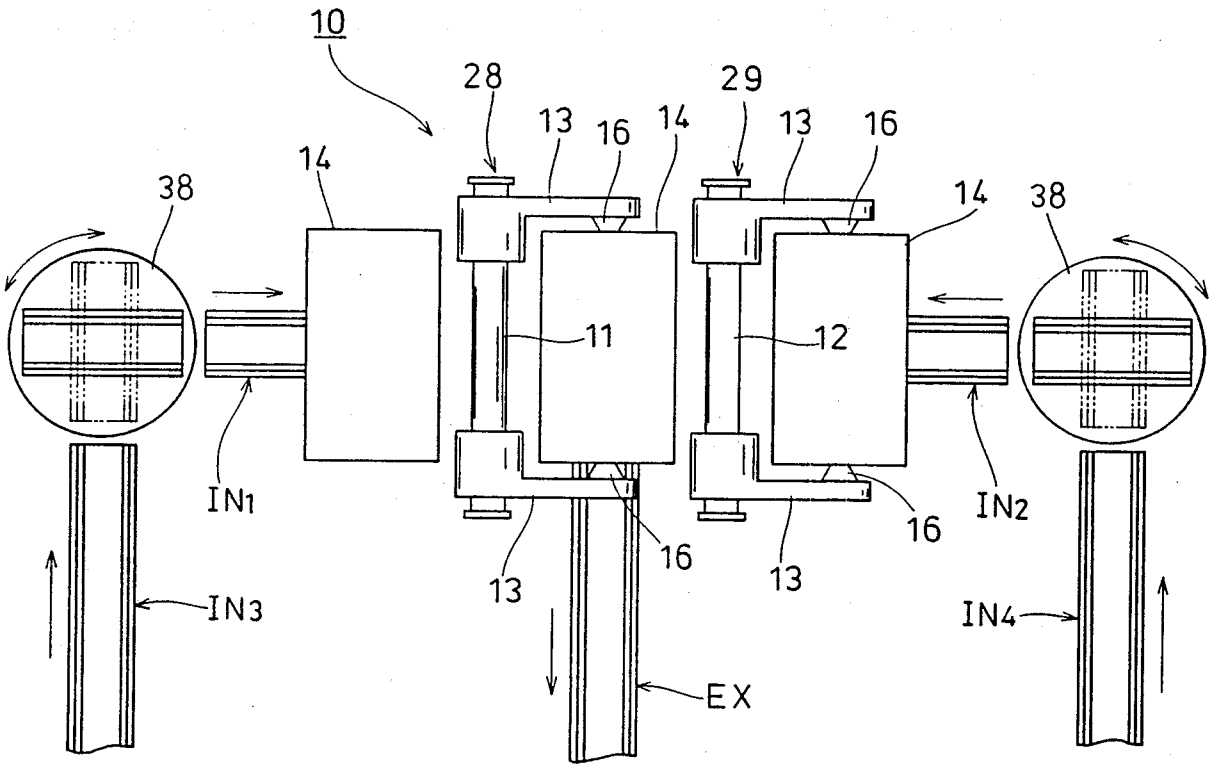
FIG. 20 shows in plan view an exemplary layout pattern when the web feeding device shown in FIG. 19 is installed in a factory.
Figure 21:
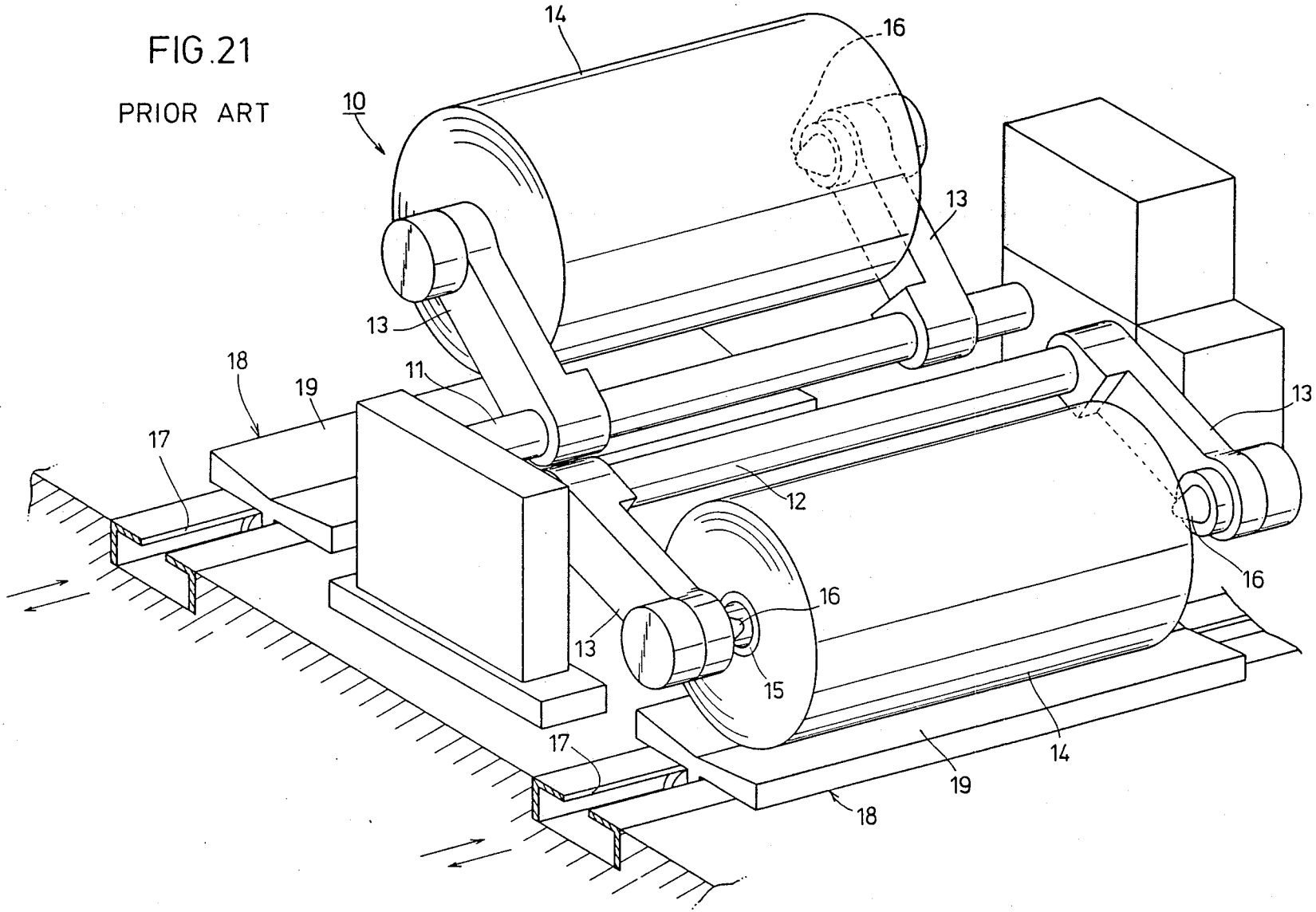
FIG. 21 PRIOR ART
FIG. 21 shows schematically a perspective view of a prior art mill roll stand.

Namely, in the web feeding device according to the embodiment shown in FIG. 19, a web roll carry-out conveyer EX is defined between the two swing arm mechanisms 28 and 29 constituting the mill roll stand 10 to extend parallel to the pivotal shafts 11 and 12, whereas at outer areas relative to the respective swing arm mechanisms 28 and 29, web roll carry-in conveyers $IN_1$ and $IN_2$ are defined to extend orthogonal with the pivotal shafts 11 and 12, respectively (see FIG. 20).

The conveyers EX, $IN_1$ and $IN_2$ for transporting web rolls 14 to be used herein each constitute a kind of free flow conveyer having the same constitution as described referring to FIG. 8, and the conveyers $IN_3$ and $IN_4$ disposed to the pits 56 and 57, respectively, likewise have a constitution similar to the above conveyers. The pallet 35 transported along the conveyer $IN_3$ ($IN_4$) is transferred to the web roll carry-in conveyer $IN_1$ ($IN_2$) in the pit 32 (33) after turning of the direction thereof with 90° by means of the turntable 38 and forwarded orthogonally to the swing arm mechanism 28 (29). Alternatively, a suitable shifting device can be used for turning the direction of the pallet 35 transported by the conveyer $IN_3$ ($IN_4$) to be transported by the carry-in conveyer $IN_1$ ($IN_2$) instead of using the turntable 38.

The roller chains 37 which constitute the conveyer driving system in each of the above conveyers EX, $IN_1$, $IN_2$, $IN_3$ and $IN_4$ have such a constitution that the removable pallet 35 may be disposed thereon to be transported thereby. The constitution of ascending or descending the pallets 35 by means of the pantographic lifters 34 disposed in the pits 31, 32 and 33 correspondingly at positions adjacent to the mill roll stand 10, respectively, should be understood to be the same as described referring to FIGS. 8 and 9.

In a device having such constitution, the lifters 34 can be omitted from the above carry-in conveyers $IN_1$ and $IN_2$ by setting the turning angle of the swing arms 13 at a greater degree whereby to allow stopping at any angle as desired, when the web roll transporting conveyers disposed at the outer areas of the two swing arm mechanisms 28 and 29, respectively, are carry-in conveyers, and further when there is no limitation for the width of the mill roll stand 10. Namely, by adjusting the turning angle of the swing arms 13 and the distance of the web roll 14 transported by the carry-in conveyer $IN_1$ ($IN_2$) relative to the pivotal shaft 11 (12), centering of the paper tube 15 in the web roll 14 with the center of the center blocks 16 can be achieved.

What is claimed is:

1. A web feeding device for a corrugator comprising: a mill roll stand consisting of two swing arm mechanisms, each having a pair of swing arms supported on a pivotal shaft which can be turned with a predetermined angle to the positive and negative directions relative to the perpendicular line extending upwardly from said pivotal shaft, disposed in such a way that the pivotal shafts thereof may be parallel to each other;

a conveyer for carrying out the web rolls disposed between said two swing arm mechanisms to extend parallel to said pivotal shafts; and web roll carry-in conveyers disposed at outer areas of said two swing arm mechanisms, respectively, and containing a reciprocatable conveyer system extended parallel to said pivotal shaft and a pallet for loading a web roll thereon to be removably mounted on said conveyer driving system; and a lifter for separating and ascending said pallet from the conveyer system and for descending and returning it to its original position, disposed for each of said carry-in conveyers at a position adjacent to the mill roll stand;

wherein the free end portions of the respective swing arms in the swing arm mechanisms are bent toward the carry-out conveyer with a predetermined angle.

2. The web feeding device for a corrugator according to claim 1, wherein said carry-out conveyer comprises a flat car having a table for loading a web roll thereon and is capable of running freely, wherein gentle slopes are formed on the top surface of said table each declining toward the center line of the table directing to the line of transportation to form a V-shaped cross-section.

3. The web feeding device for a corrugator according to claim 1, wherein a guide member whose top surface is declined toward the carry-out conveyer is disposed at an inner area of the two swing arm mechanisms disposed on both sides of said carry-out conveyer.

4. A web feeding device for a corrugator comprising:

a mill roll stand comprising two swing arm mechanisms, each having a pair of swing arms supported on a pivotal shaft which can be turned with a predetermined angle to the positive and negative directions relative to the perpendicular line extending upwardly from said shaft, disposed in such a way that the pivotal shafts thereof may be parallel to each other;

a web roll carry-in conveyer disposed between said two swing arm mechanisms and comprising a reciprocatable conveyer driving system extending parallel to said pivotal shafts and a pallet for loading a web roll thereon to be removably mounted to said conveyer driving system;

web roll carry-out conveyers disposed at outer areas relative to said two swing arm mechanisms to extend parallel to said pivotal shaft; and a lifter for separating and ascending said pallet from the conveyer driving system and for descending and returning it to its original position, disposed for each of said carry-in conveyers at a position adjacent to the mill roll stand;

wherein the free end portions of the respective swing arms in the swing arm mechanisms are bent away from the carry-in conveyer with a predetermined angle.

5. The web feeding device for a corrugator according to claim 4, wherein said carry-out conveyer comprises a flat car having a table for loading a web roll thereon and is capable of running freely, wherein gentle slopes are formed on the top surface of said table each declining toward the center line of the table directing to the line of transportation to form a V-shaped cross-section.

6. The web feeding device for a corrugator according to claim 4, wherein a guide member whose top surface is declined toward the carry-out conveyer is disposed on both sides of said carry-out conveyer.

7. A web feeding device for a corrugator for use in a factory site comprising:

a mill roll stand consisting of two swing arm mechanisms, each having a pair of swing arms supported on a pivotal shaft which can be turned at a predetermined angle to positive and negative directions relative to a perpendicular line extending upwardly from said pivotal shaft, said pivotal shafts being parallel to each other;

a web roll carrying-out conveyor provided between said two swing arm mechanisms and parallel to said pivotal shafts; and two web roll carrying-in conveyers provided in outer areas relative to said two swing arm mechanisms, respectively, and parallel to said pivotal shafts; wherein each of said web roll carrying-out and carrying-in conveyors comprises:

a conveyor driving system comprising a pair of parallel endless chains reciprocating in a pit which is provided in said factory site, horizontal upper portions of said horizontal endless chains being set slightly below an opening of said pit;

a pallet having a roll loading surface and a bottom surface wherein said roll loading surface comprises two slant planes mutually facing each other so that said web roll is stably loaded thereon and said bottom surface is provided with two parallel perpendicular protruding portions, said pallet being mounted on said upper portions of said endless chains so as to be separated therefrom with said protruding portions facing down from said opening of said pit; and a lifter provided in said pit which is installed adjacent to said mill roll stand, said lifter being arranged and configured such that said lifter normally positions at a height level not preventing movements of said pallet, lifts said pallet upon a predetermined command to a predetermined height level by separating said pallet from said upper portions of said endless chains and then upon a next command lowers said pallet so that said pallet is mounted back on said upper portion of said endless chains.

8. A web feeding device for a corrugator comprising:

a mill roll stand consisting of two swing arm mechanisms, each having a pair of swing arms supported on a pivotal shaft which can be turned with a predetermined angle to positive and negative directions relative to a perpendicular line extending upwardly from said pivotal shaft, disposed in such a way that the pivotal shafts thereof may be parallel to each other;

a conveyor for transporting the web rolls disposed between said two swing arm mechanisms to extend parallel to said pivotal shafts, said web roll transporting conveyor disposed intermediate between said two swing arm mechanisms comprising a conveyor for carrying in web rolls; and two web roll transporting conveyers disposed at outer areas relative to the swing arm mechanisms, respectively, to be extended parallel to said pivotal shafts, said two web roll transporting conveyors disposed at outer areas relative to the two swing arm mechanisms, respectively, comprising conveyors for carrying out web rolls.

9. A web feeding device for a corrugator for use in a factory site comprising:

a mill roll stand consisting of two swing arm mechanisms, each having a pair of swing arms supported on a pivotal shaft which can be turned at a predetermined angle to positive and negative directions relative to a perpendicular line extending upwardly from said pivotal shaft, said pivotal shafts being parallel to each other;

a web roll carrying-out conveyor provided between said two swing arm mechanisms and parallel to said pivotal shafts; and two web roll carrying-in conveyers provided in outer areas relative to said two swing arm mechanisms, respectively, and orthogonal to said pivotal shafts; wherein each of said web roll carrying-out and carrying-in conveyors comprises:

a conveyor driving system which is a pair of parallel endless chains reciprocating in a pit which is provided in a factory site, horizontal upper portions of said horizontal endless chains being set slightly below an opening of said pit;

a pallet having a roll loading surface and a bottom surface wherein said roll loading surface comprises two slant planes mutually facing each other so that said web roll is stably loaded thereon and said bottom surface is provided with two parallel perpendicular protruding portions, said pallet being mounted on said upper portions of said endless chains so as to be separated therefrom with said protruding portions facing down from said opening of said pit; and a lifter provided in said pit which is installed adjacent to said mill roll stand, said lifter being arranged and configured such that said lifter normally positions at a height level not preventing movements of said pallet, lifts said pallet upon a predetermined command to a predetermined height level by separating said pallet from said upper portions of said endless chains and then upon a next command lowers said pallet so that said pallet mounted back on said upper portion of said endless chains.

10. A web feeding device for a corrugator comprising:

a mill roll stand consisting of two swing arm mechanisms, each having a pair of swing arms supported on a pivotal shaft which can be turned with a predetermined angle to positive and negative directions relative to the perpendicular line extending upwardly from said pivotal shaft, disposed in such a way that the pivotal shafts thereof may be parallel to each other;

a web roll transporting conveyor disposed between said two swing arm mechanisms to extend in parallel to said pivotal shafts, said web roll transporting mechanism disposed intermediate between the two swing arm mechanisms comprising a conveyor for carrying in web rolls; and web roll transporting conveyers disposed at outer areas relative to the two swing arm mechanisms to extend orthogonal with said pivotal shafts, said two web roll transporting conveyors disposed at outer areas relative to said two swing arm mechanisms comprising conveyors for carrying out web rolls.

* * * * *